US009528372B2

(12) United States Patent
Selman et al.

(10) Patent No.: US 9,528,372 B2
(45) **Date of Patent: *Dec. 27, 2016**

(54) METHOD FOR NEAR REAL TIME SURFACE LOGGING OF A HYDROCARBON OR GEOTHERMAL WELL USING A MASS SPECTROMETER

(71) Applicant: SELMAN AND ASSOCIATES, LTD, Midland, TX (US)

(72) Inventors: Thomas H. Selman, Midland, TX (US); Matthew J. Jennings, Midland, TX (US)

(73) Assignee: SELMAN AND ASSOCIATES, LTD., Midland, TX (US)

( * ) Notice: Subject to any disclaimer, the term of this patent is extended or adjusted under 35 U.S.C. 154(b) by 575 days.

This patent is subject to a terminal disclaimer.

(21) Appl. No.: 14/064,048

(22) Filed: Oct. 25, 2013

(65) Prior Publication Data

US 2015/0039233 A1 Feb. 5, 2015

Related U.S. Application Data

(63) Continuation-in-part of application No. 14/038,703, filed on Sep. 26, 2013, which is a continuation-in-part (Continued)

(51) Int. Cl.

| | |
|---|---|
| ***E21B 49/08*** | (2006.01) |
| ***E21B 47/022*** | (2012.01) |
| ***E21B 49/00*** | (2006.01) |

(52) U.S. Cl.

CPC ..... *E21B 49/088* (2013.01); *E21B 47/022* (2013.01); *E21B 49/005* (2013.01)

(58) Field of Classification Search

None

See application file for complete search history.

(56) References Cited

U.S. PATENT DOCUMENTS 2,752,777 A 10/1950 Jacobs et al.
2,752,776 A 4/1954 Kapff et al.
(Continued)

FOREIGN PATENT DOCUMENTS

WO 9641066 12/1996

OTHER PUBLICATIONS

"Model 400A Hydrocarbon Analyzer" Product Data Sheet, PDS 103-400A.A01, Jan. 2009.*

*Primary Examiner* — Alexander Satanovsky
*Assistant Examiner* — John Kuan
(74) *Attorney, Agent, or Firm* — Buskop Law Group, PC; Wendy Buskop

(57) ABSTRACT

An automatic method for providing geological trends and real time mapping of a geological basin using a mass spectrometer. The method provides information from a mass spectrometer on fluid samples from a wellbore into a geochemical surface well log with graphical tracks in real time. The dataset includes geochemical, engineering, and geological. The viewable geochemical well log provides information on well fluids and rock, and displays data in graphical tracks on client devices. The mass spectrometer receives samples from a gas trap connected to the wellbore, performs analysis on the samples, and communicates in real time to a geochemical surface well log with a plurality of graphical tracks which is then further communicated to a client device via a network.

28 Claims, 12 Drawing Sheets

Related U.S. Application Data of application No. 13/029,666, filed on Feb. 17, 2011, now Pat. No. 8,838,390, and a continuation-in-part of application No. 13/744,378, filed on Jan. 17, 2013, now Pat. No. 8,614,713, and a continuation-in-part of application No. 13/744,382, filed on Jan. 17, 2013, now Pat. No. 8,682,586, and a continuation-in-part of application No. 13/744,388, filed on Jan. 17, 2013, now Pat. No. 8,701,012, application No. 14/064,048, which is a continuation-in-part of application No. 14/038,711, filed on Sep. 26, 2013, which is a continuation-in-part of application No. 13/281,419, filed on Oct. 25, 2011, now Pat. No. 8,996,316, which is a continuation-in-part of application No. 12/879,708, filed on Sep. 10, 2010, now Pat. No. 8,463,549, and a continuation-in-part of application No. 12/879,732, filed on Sep. 10, 2010, now Pat. No. 8,463,550.

(56) References Cited

U.S. PATENT DOCUMENTS 4,272,258 A 6/1981 Shifflett
4,358,298 A 11/1982 Ratcliff
4,414,651 A 11/1983 Buckner
4,565,086 A 1/1986 Orr, Jr.
4,616,321 A 10/1986 Chan
4,670,139 A 6/1987 Spruiell et al.
4,831,559 A 5/1989 Miller
5,058,674 A 10/1991 Schultz et al.
5,199,509 A 4/1993 Wright et al.
5,237,539 A 8/1993 Selman
5,329,811 A 7/1994 Schultz et al.
5,648,603 A 7/1997 Hanson
5,869,343 A 2/1999 Handschuck et al.
6,073,709 A 6/2000 Hensley
6,101,445 A 8/2000 Alvarado et al.
6,195,092 B1 2/2001 Dhond et al.
6,496,309 B1 12/2002 Bilton et al.
6,505,523 B1 1/2003 Taylor et al.
6,546,818 B2 4/2003 Taylor et al.
6,609,433 B2 8/2003 Taylor et al.
6,666,099 B2 12/2003 Taylor
6,704,656 B1 3/2004 Abriol et al.
6,760,665 B1 7/2004 Francis
7,099,003 B2 8/2006 Saptari et al.
7,210,342 B1 5/2007 Sterner et al.
7,219,541 B2 5/2007 DiFoggio et al.
7,395,691 B2 7/2008 Sterner et al.
7,794,527 B2 9/2010 Sterner
7,844,400 B1 11/2010 Selman et al.
7,957,903 B1 6/2011 Selman et al.
8,132,452 B1 3/2012 Selman et al.
8,204,717 B2 6/2012 McLaughlin et al.
8,214,188 B2 7/2012 Bailey et al.
2001/0048074 A1* 12/2001 Shiokawa ..... H01J 49/145 250/286
2007/0050154 A1 3/2007 Albahri
2008/0065344 A1* 3/2008 Parker ..... E21B 47/00 702/127
2008/0208475 A1 8/2008 Karr et al.
2008/0249790 A1 10/2008 Sinclair et al.
2008/0289877 A1 11/2008 Nikolakis-Mouchas et al.
2009/0132458 A1 5/2009 Edwards et al.
2010/0027004 A1 2/2010 Bonyuet et al.
2010/0089120 A1 4/2010 Hanson
2010/0131482 A1 5/2010 Linthicum et al.
2010/0175467 A1 7/2010 DiFoggio et al.
2011/0048700 A1 3/2011 van Zuilekom et al.
2011/0071963 A1 3/2011 Piovesan et al.
2011/0308391 A1 12/2011 DeGreeve et al.
2012/0274664 A1* 11/2012 Fagnou ..... G06F 3/04855 345/660
2013/0035863 A1 2/2013 Selman et al.
2013/0043380 A1* 2/2013 Correale ..... G01N 1/2202 250/252.1
2013/0087698 A1* 4/2013 Pomerantz ..... H01J 49/26 250/254
2013/0144531 A1* 6/2013 Johnston ..... E21B 44/00 702/9

* cited by examiner

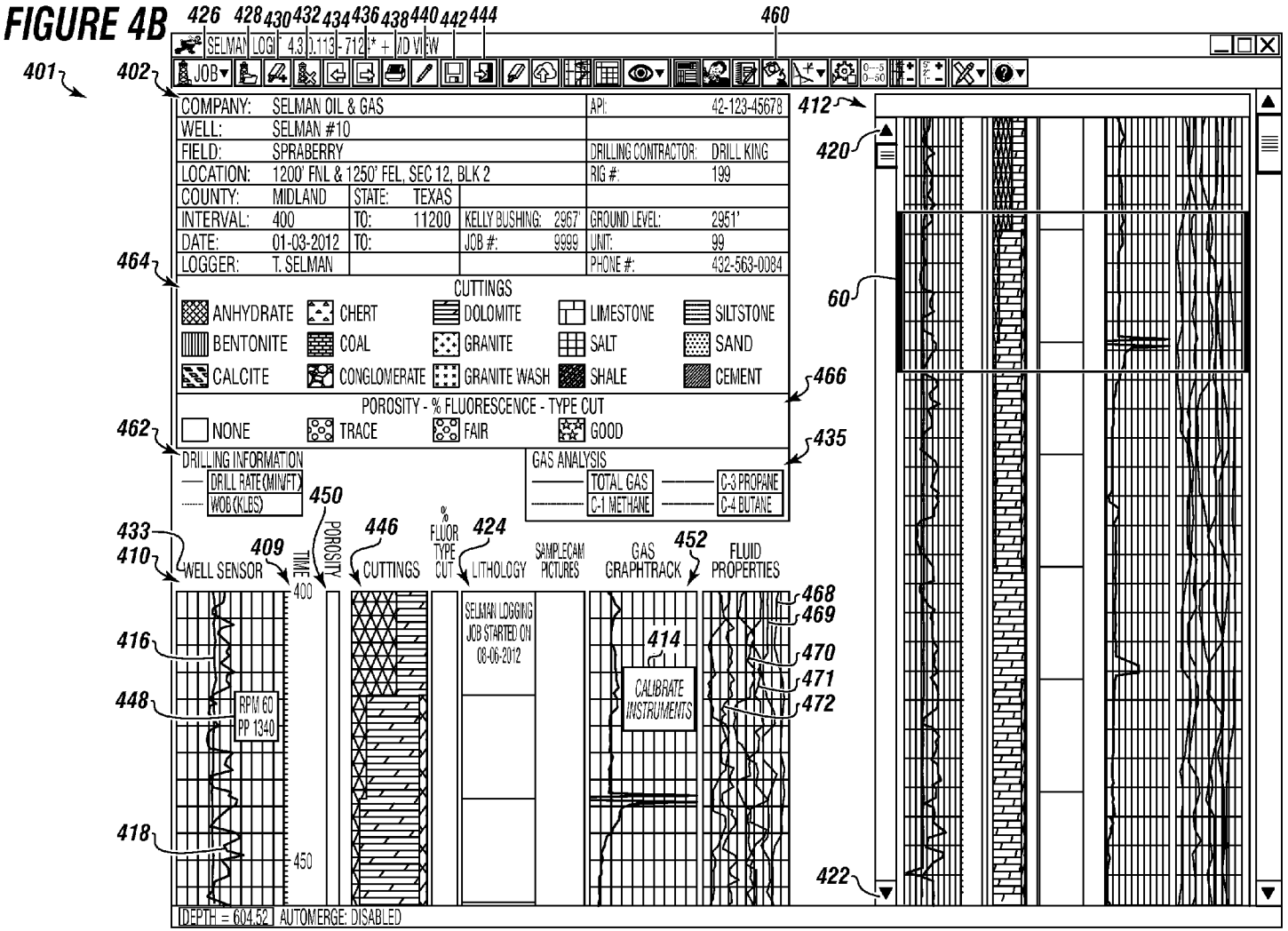
COMPANY: SELMAN OIL & GAS
WELL: SELMAN #10
FIELD: SPRABERRY
LOCATION: 1200' FNL & 1250' FEL, SEC 12, BLK 2
COUNTY: MIDLAND
STATE: TEXAS
INTERVAL: 400
TO: 11200
DATE: 01-03-2012
LOGGER: T. SELMAN
API: 42-123-45678
DRILLING CONTRACTOR: DRILL KING
RIG #: 199
KELLY BUSHING: 2967'
GROUND LEVEL: 2951'
JOB #: 99999
UNIT: 99
PHONE #: 432-563-0084
CUTTINGS
ANHYDRATE
BENTONITE
CALCITE
CHERT
COAL
CONGLOMERATE
DOLOMITE
GRANITE
GRANITE WASH
LIMESTONE
SALT
SHALE
SILTSTONE
SAND
CEMENT
POROSITY - % FLUORESCENCE - TYPE CUT
NONE
TRACE
FAIR
GOOD
GAS ANALYSIS
TOTAL GAS
C-1 METHANE
C-3 PROPANE
C-4 BUTANE
DRILLING INFORMATION
DRILL RATE (MIN/FT)
WOB (KLBS)
WELL SENSOR
POROSITY
TIME
CUTTINGS
% FLUOR TYPE CUT
LITHOLOGY
SAMPLE CAM PICTURES
GAS GRAPH TRACK
FLUID PROPERTIES
CALIBRATE INSTRUMENTS
SELMAN LOGGING
JOB STARTED ON
08-06-2012
RPM 60
PP 1340
DEPTH = 604.52
AUTOMERGE: DISABLED
FIGURE 4B
401
402
409
410
412
414
416
418
420
422
424
426
428
430
432
433
434
435
436
438
440
442
444
446
448
450
452
460
462
464
466
468
469
470
471
472

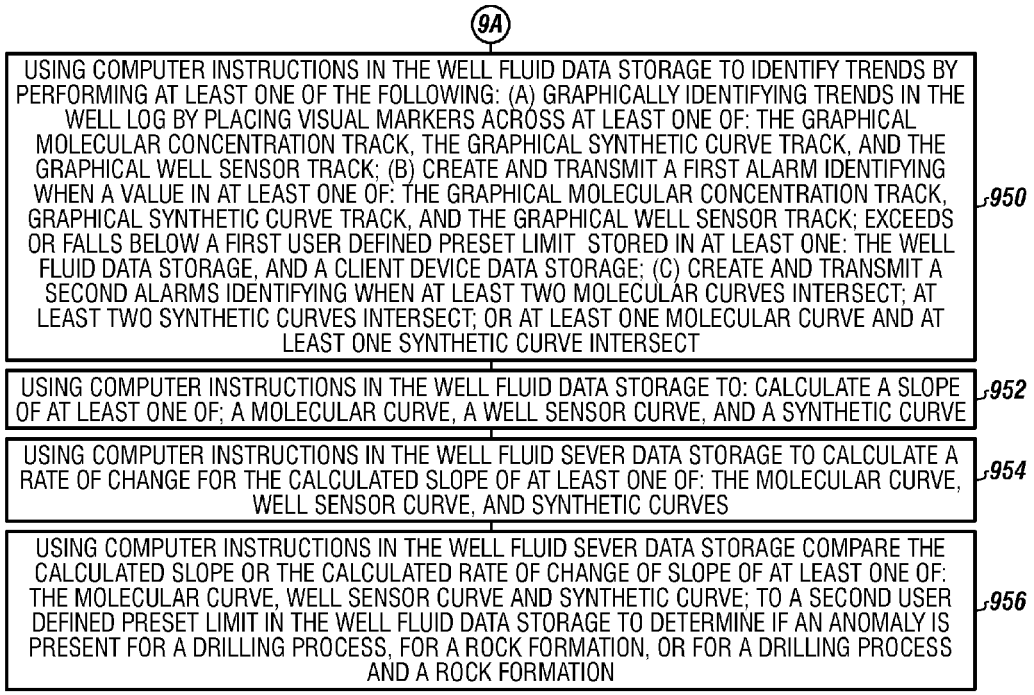
FIGURE 9B
FIGURE 10
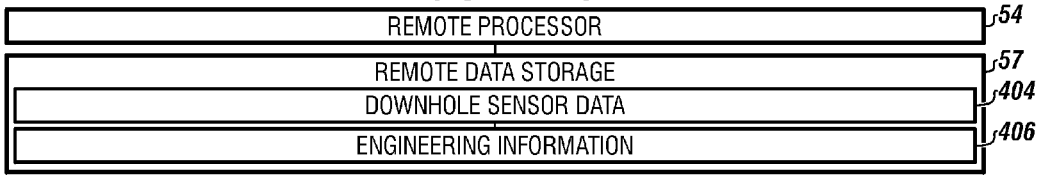

METHOD FOR NEAR REAL TIME SURFACE LOGGING OF A HYDROCARBON OR GEOTHERMAL WELL USING A MASS SPECTROMETER

CROSS REFERENCE TO RELATED APPLICATIONS

The present application is a Continuation in Part of co-pending Utility patent application Ser. No. 14/038,703 filed on Sep. 26, 2013, entitled "METHOD FOR NEAR REAL TIME SURFACE LOGGING OF A GEOTHERMAL WELL, A HYDROCARBON WELL, OR A TESTING WELL USING A MASS SPECTROMETER;" is a Continuation in Part of co-pending Utility patent application Ser. No. 14/038,711 filed on Sep. 26, 2013, entitled "SYSTEM FOR NEAR REAL TIME SURFACE LOGGING OF A GEOTHERMAL WELL, A HYDROCARBON WELL, OR A TESTING WELL USING A MASS SPECTROMETER," which claim priority to co-pending U.S. patent application Ser. No. 13/029,666 filed on Feb. 17, 2011, entitled "SYSTEM FOR GAS DETECTION, WELL DATA COLLECTION AND REAL TIME STREAMING OF WELL LOGGING DATA," co-pending U.S. patent application Ser. No. 13/744,378 filed on Jan. 17, 2013, entitled "COMPUTER IMPLEMENTED METHOD TO CREATE A NEAR REAL TIME WELL LOG," co-pending U.S. patent application Ser. No. 13/744,382 filed on Jan. 17, 2013, entitled "SYSTEM FOR CREATING A NEAR REAL TIME WELL LOG," and co-pending U.S. patent application Ser. No. 13/744,388 filed on Jan. 17, 2013, entitled "COMPUTER READABLE MEDIUM FOR CREATING A NEAR REAL TIME WELL LOG;" and is a Continuation in Part of co-pending Utility patent application Ser. No. 13/281,419 filed on Oct. 25, 2011 entitled "SYSTEM AND METHOD FOR FRACTIONATION OF A WELL USING A THREE DIMENSIONAL WELLBORE PROFILE WITH AN EXECUTIVE DASHBOARD," which claims priority to U.S. patent application Ser. No. 12/879,708 filed on Sep. 10, 2010, entitled "METHOD FOR GEOSTEERING DIRECTIONAL DRILLING APPARATUS," issued as U.S. Pat. No. 8,463,549 on Jun. 11, 2013 and U.S. patent application Ser. No. 12/879,732 filed on Sep. 10, 2010, entitled "SYSTEM FOR GEOSTEERING DIRECTIONAL DRILLING APPARATUS," issued as U.S. Pat. No. 8,463,550 on Jun. 11, 2013. These references are incorporated in their entirety.

FIELD

The present embodiments relate to an automatic computer implemented method for creating a geochemical surface well log in near real time using a mass spectrometer and producing a well log with at least one graphical drilling track for a geothermal, hydrocarbon or testing well using digital sensed data from sensors, analyzed data from fluid analyzers, in conjunction with exploring the earth's subsurface for economic, producible hydrocarbons.

BACKGROUND

A need exists for a method to produce an accurate geochemical surface well log in near real time that provides analysis from a mass spectrometer and provides graphical drilling tracks of the analysis information for using an executive dashboard and a well log template.

A need exists for a graphical method for providing near real time surface logging information on hydrocarbon or geothermal wells using a mass spectrometer.

The present embodiments meet these needs.

BRIEF DESCRIPTION OF THE DRAWINGS

The detailed description will be better understood in conjunction with the accompanying drawings as follows:

FIG. 4B depicts a partially populated geochemical well log template according to one or more embodiments.

FIGS. 9A-9B depict the sequence of steps of an embodiment of the method.

FIG. 10 depicts a remote data storage in communication with a remote processor.

Figure 1:
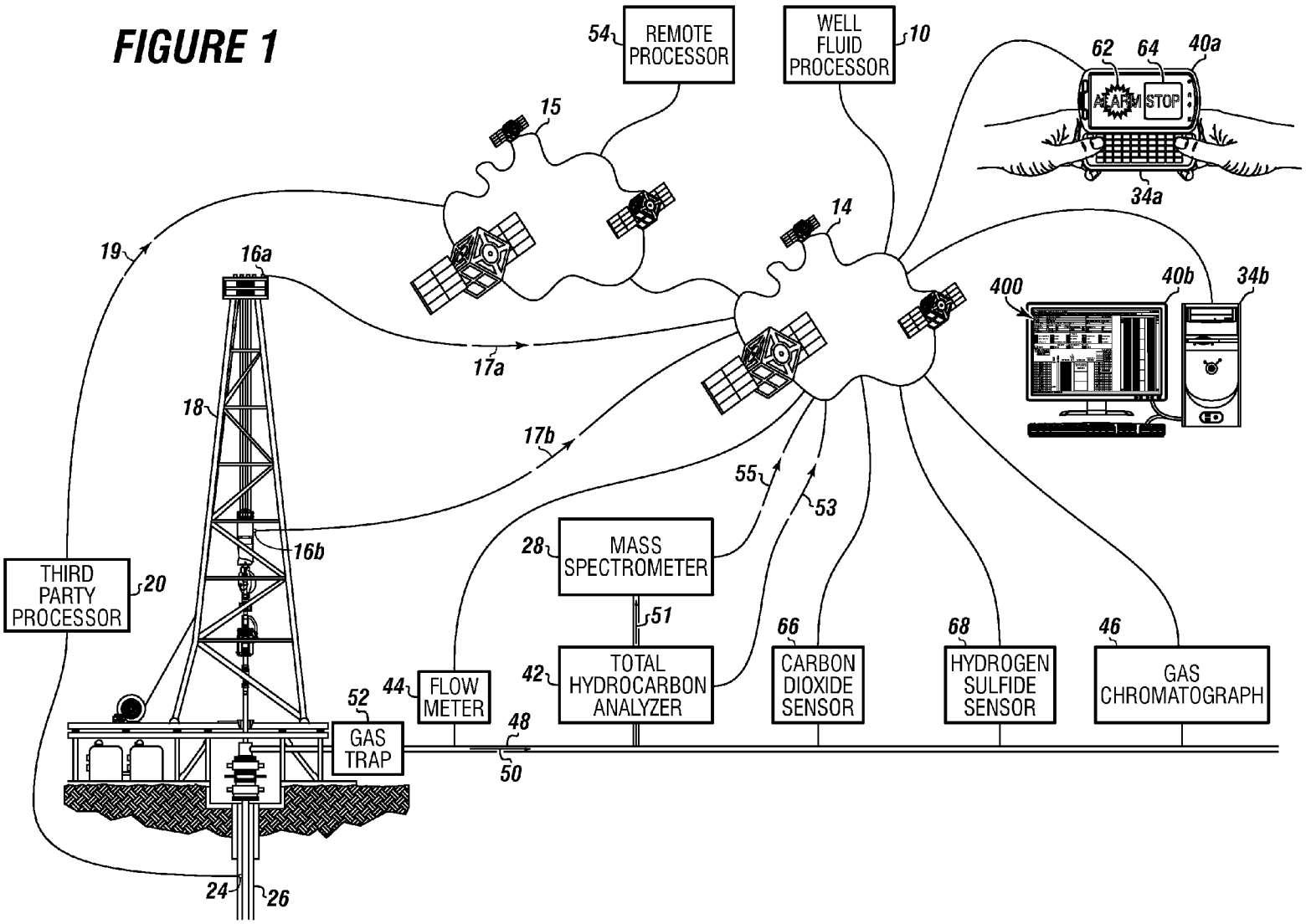
FIG. 1 depicts an embodiment of the system usable to implement the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The embodiments relate to an automatic computer implemented method for providing geological trends and real time mapping of a geological basin using a mass spectrometer.

The method is a continuous and automatic method for analyzing fluids from boreholes in near real time for a geothermal, hydrocarbon, or testing well, and communicating the analyzed fluid information to at least one client device using a network.

The method involves connecting a well fluid processor with well fluid data storage the network.

The method involves connecting a total hydrocarbon analyzer to a wellbore to receive wellbore fluid samples and produce positive pressure fluid samples.

The method involves performing fluid analysis using the total hydrocarbon analyzer on the wellbore fluid samples forming total hydrocarbon analyzer fluid testing data.

The method involves electronically communicating total hydrocarbon analyzer fluid testing data to a network and to a well fluid processor in electronic communication with the network. The invention involves forming positive pressure wellbore fluid samples using the wellbore fluid samples.

The method involves connecting a mass spectrometer to the network.

The mass spectrometer can have a mass spectrometer processor, a mass spectrometer data storage; computer instructions to measure a mass to charge ratio of molecular weights for components continuously sampling drilling fluids coming from the wellbore; and computer instructions to communicate the mass to charge ratios of molecular weights to the well fluid processor as mass spectrometer fluid testing data while the sampling occurs continuously.

The method involves continuously flowing the positive pressure fluid samples to the mass spectrometer.

The method involves measuring a mass to charge ratio of molecular weights of components for the continuously flow of the positive pressure fluid sample stream as mass spectrometer fluid testing data.

The method involves communicating mass spectrometer fluid testing data to the network.

The method involves calculating molecular concentrations to identify molecular species of the positive pressure fluid samples using computer instructions in the well fluid data storage.

The method also involves transmitting identified molecular species to at least one client device via the network using computer instructions in the well fluid data storage.

The method provides in real time, such as within 1 minute to 10 minutes, or within a short period of time, such as within 1 hour to 3 hours, information from a mass spectrometer on fluid samples from a wellbore, into a geochemical surface well log.

The method can use geochemical, engineering, and geological data as the dataset.

The method creates a geochemical surface well log after populating the geochemical well log template. The geochemical surface well log can be viewable on a plurality of client device simultaneously. The geochemical surface well log can have graphical drilling tracks, that is, the geochemical well log provides information on well fluids and rock, and displays data in graphical tracks.

The method can create a well log with a macroview log plot and a microview log plot for graphically viewing the well log information.

The method can create an executive dashboard that can be viewed and used to create a customizable and changeable geochemical surface well log.

The method can create an operator dashboard usable simultaneously with the executive dashboard to view the well log information and fluid testing data.

In this method, the mass spectrometer receives fluid samples which can be from a total hydrocarbon analyzer that receives the fluid samples from a gas trap in fluid communication with a wellbore.

The mass spectrometer can perform analysis on the positive pressure fluid samples from the total hydrocarbon analyzer, and electronically communicates the fluid analysis information in real time over a network to a well fluid processor with well fluid data storage. The well fluid processor uses computer instructions in the well fluid data storage to create a geochemical well log template that is used to form the geochemical well log.

The communication from the mass spectrometer to the well fluid processor can be in real time, which can be within 1 minute to 10 minutes or within a short time, for insertion into a geochemical surface well log presenting the analysis data in a plurality of graphical tracks.

The geochemical surface well log is populated with fluid analysis information from the mass spectrometer using computer instructions that present the fluid analysis in the geochemical surface well log as graphic drilling tracks. The geochemical surface well log can then be further communicated to a plurality of client devices simultaneously via a network.

Additional computer instructions can be used to perform analysis of trends in the data of the geochemical surface well log enabling geologists and other users to map and model a geological basin in near real time is performed.

The method prevents drilling into a geological zone that causes well fluid blowouts.

The method can be used to accurately control the drilling of relief wells when a blown out well is on fire.

The method is used to prevent emission of highly toxic deadly gas over a densely populated area while drilling.

The method can prevent drill bits from exiting the surface and leaving the target zone as an unscheduled event.

The method allows a geologist in real time, to determine a near drilling bit lithology to stay within a target zone, negating the possibility of a drill bit exiting the target zone and possibly exiting the surface as an unscheduled event.

The method enables the drill well fluid to be safer for workers, so that injury and death are avoided at a well fluid site.

The embodiments can provide an early warning for the presence of dangerous toxic gas zones enabling a driller to steer away from those zones.

The embodiments can enable multiple users viewing the well log to alert a driller to move away from a hazardous gas zone, so that a highly toxic gas does not cripple hundreds of people in a populated area.

The embodiments can monitor for proper lithology proximate the drill bit during drilling in real time with up to the minute information.

The embodiments can enable a driller to determine a near bit lithology to stay within a target zone, negating the possibility of a drill bit exiting the target zone and potentially exiting the surface as an unscheduled event.

The embodiments can enable drillers to have a safer work environment. The use of the well log with mass spectroscopy data graphically presented can help prevent the occurrence of unscheduled events which have been statistically proven to cause accidents and unsafe conditions.

The embodiments can reduce the exposure time for drilling into hazardous zones, by conducting drilling operations in a more accurate manner, so that the risk of injury is greatly reduced.

The method creates a constantly updatable well log that shows simultaneously, a rate of penetration for the well bit, a weight on the well bit, mass spectroscopy analysis information for gas entrained in drilling fluid used while drilling the well.

The following definitions are used in herein.

The term "actual real time" as used herein can refer to data that can be displayed in the surface well log as an event occurs during drilling. The actual real time data can be gas analysis data or sensor reading data that can be provided to the computer readable medium as soon at the gas analysis or sensor reading is obtained.

The term "client device" as used herein can refer to a computer, a laptop, a cell phone, a tablet, a smart phone, a server, or a cloud computing platforms of connected cloud processors and cloud data storage.

The term "engineering curve" as used herein can refer to a curve that shows trends in wear of equipment.

The term "engineering information" as used herein can refer to at least one of: hole depth which can be: hole depth measured to TD, true vertical depth, sample depth (also known as lag); drillability curves; rates of penetration of a drill bit; mud properties such as mud weight, viscosity, pH, chloride content, temperature, water loss; survey data such as azimuth inclination; standpipe pressure; casing pressure; pump stroke rates; torque on drilling equipment; rotary speed of the drilling equipment such as rotation per minute (rpm) of the drill bit; bit rotation of the drill bit; wellbore hole geometry including casing depth information and/or depths of tubular connection; and information on tubulars being run into casing. Similar information can be included as engineering information. The "engineering information" can include a calculation on wear on drilling equipment using computer instructions from the well sensor information. The engineering information can include a calculation for at least one of: a potential mechanical failure for drilling equipment, such as failure of a mud pump, or a calculation for a rate of wear on drilling equipment, such as rate of wear on a drilling bit.

The term "geological information" as used herein can refer to at least one of: rock lithology description, trace rock porosity, rock type, percent fluorescence of rock; type hydrocarbon cuttings; percent drill cuttings.

The term "geochemical surface well log" as the term is used herein can refer to a presentation of surface well drilling data that is geochemical. Geochemical information includes data and information referring to an entire logging interval from start time to stop time as well as a defined depth, such as a first 400 feet of a well. The geochemical surface well log can contain all data, the index, comments, the headers, the footers, the user information and service provider contact information.

The term "geochemical testing information" as used herein can refer to at least one of: drilling mud gas content aromatic hydrocarbons, alkanes, cycloalkanes, nitrogen, oxygen, argon, water vapor, carbon dioxide, helium hydrogen, hydrogen sulfide, sulfur monoxide, sulfur dioxide, carbon disulfide, molecular ratios using analyzed species of molecules. The geochemical information includes at least one of a reservoir analysis, such as detection of oil in shale or, fluid migration identification such as migration of oil through a fractionation field; anomaly reservoir identification such as a concentration of one type of geological features or in kind parameters forming a trend such as a rising fault line towards the surface or a subsurface fold or an anticline or a syncline; a tracking of heavier hydrocarbons than measurable with a gas chromatograph such as tracking of hexane, a source rock identification such as identification of shale, and a fluid movement analysis through rock, such as trend analysis showing an increase in oil in a compass direction after water is pumped into a well.

The term "graphical well sensor track" refers to graphical depiction first over time and second over depth of one or more types of well sensor information, such as standpipe pressure or casing pressure.

The term "molecular ratios" as used herein can refer to mathematical formulas that use molecular species from the tested geochemical information to form synthetic curves. The mathematical formulas can for example, create Pixler ratios, wetness, balance, character ratios, and heavy to light ratios.

The term "macroview log plot" as used herein can refer to a graphical depiction of an entire portion of the well log. The macroview log plot is a visual presentation of a compressed view of the entire well log. The macroview log plot can depict the entire drilling project at any point in time. In embodiments, the macroview log plot has an index, scaled values, and lithology comments.

In embodiments, the macroview log plot can further include a shaded box graphically depicting an area of the microview log plot. The macroview log plot can be graphically displayed in color or as a shaded area.

The term "mass spectrometer analyzer can" refer to an inline analyzer that continuously receives fluid samples form a gas trap.

Usable mass spectrometers for this system measure for components of process gasses quantitatively and for purity of components found in process gases. Quadropole mass spectrometers are particularly usable herein.

The term "microview log plot" as used herein can refer to a graphical depiction of a small portion of the well log. A microview log plot has an index and scaled values for a defined drilling interval, less than the entire logging interval. The microview log plot has at least one graphical drilling information track, and lithology comments. In embodiments, the microview log plot has a header with user information and or service provider contact information.

The term "molecular curves" can refer to computed curves using molecular concentrations from the mass spectrometer.

The term "near real time" as used herein can refer to the time interval between when data is received for analysis and analysis is performed and displayed on the geochemical surface well log which is within 1 minute to 3 hours, for example a time interval as short as 1 minute to 3 minutes.

The term "network" can refer to a satellite network, a cellular network, a local area network, a wide area network, the Internet, another global communication network or multiple networks connected together.

The term "synthetic curve" as used herein can refer to a curve that is created by applying a mathematical operation to two or more concentrations of analyzed molecular species. The "synthetic curve" refers to engineering data that is plotted either over time or over depth. For example a synthetic curve could be plotted against time or depth or both showing a "drillability curve" referred to as a Dexponent or DCexponent. Another type of synthetic curve could be formed termed "equivalent circulating density ECD" for mud properties, which allows a geologist to manage mud properties which is plotted against depth and time.

The term "trends" as used herein can refer to trends identified in the geochemical surface well log which include trends that can show geochemical data across a geological basin and across multiple wellbores. Trends can be identified in the geochemical well log for a single wellbore. The term "trends" can include graphically viewable trends in the well log that identify boundaries of one or more geological features on a macro or micro level. The term "trends" can include trends that identify features of geologic interest.

Within the scope of the embodiments, trends identify movement or migration of identified fluids through rock. Additionally the trends can show patterns in rock to depict the evolution of a reservoir. Trace elements of molecules can indicate how the reservoir evolved and since a reservoir changes when fractionation is performed, trace elements shown in the well log can depict patterns showing the changes in the reservoir as production continues into the future.

The graphical display of trends in the geochemical surface well log allows geologists to create regional or local geological mapping for a geological basin Trends visually allow a geologist to see the evolution of a productive geological basin from an economic standpoint. The mapping of the reservoirs allows the geologists and engineers working on the drilling site to make projections in time on the return of investment on the drilling and to reorient drilling if needed due to safety reasons.

The term "user information" as used herein can refer to the name of the well, the name of the well operator, the location of the well, the height of the Kelly Bushing of the well and an American Petroleum Institute (API) number or a Unique Well Identifier from the Canadian counterpart to the API. The user information can include a target depth of the well to be drilled, the name of the drilling owner, the name of the well logger, a ground level of the well.

The term "wellbore" as used herein can refer to a bore of a hydrocarbon and geothermal well being drilled with a drill bit using a drilling well fluid. It can also refer to a well that is being fractionated or "worked over."

The term "well sensors" as used herein can refer to sensors that detect concentrations of components in gas or concentrations of components in fluids coming from the wellbore.

The term "well sensor curves" or "sensed curves" can refer to curves depicting an average weight on bit plotted against depth, an instant average reading, as well as rates of penetration for a well bit plotted against depth. Many of these curves are plotted against depth. The well sensor curves can also be plotted against time. A feature of the invention is the ability to toggle between well sensor curves over depth and well sensor curves over time. The well sensor curve can be a plot of pump pressure versus time. Bit torque can also be portrayed as a well sensor curve over time or over depth or both.

The term "well sensor information" as used herein can refer to information from sensors that detect gas trapped in drilling mud, gas trapped in drilling cuttings, and sensors that detect fluids in the drilling muds and drill cuttings.

The embodiments relate to an automatic method for creating a geochemical surface well log in near real time with at least one graphical drilling track for a geothermal, hydrocarbon, or testing well, using digital sensed data from sensors, analyzed data from analyzers, the geochemical surface well log comprising at least one of geochemical testing information, geological information, engineering information, and communicating the geochemical surface well log to a client device over a network.

Turning now to the Figures, FIG. 1 depicts an embodiment of the system usable to implement the method. The system can use a well fluid processor 10 connected to a first network 14. The well fluid processor can have a well fluid data storage containing a plurality of computer instructions. The well fluid data storage can receive and store fluid testing data and data from rig sensors and downhole sensors.

The well fluid processor can communicate with at least one sensor 16*a* on a drilling rig 18. Two sensors 16*a* and 16*b* are shown that can measure temperature, pressure, vibration and any number of additional physical phenomena. The sensors can transmit rig sensor information 17*a* and 17*b* to the well fluid processor.

The well fluid processor 10 can communicate with a third party processor 20 through a second network 15 connected to the first network 14. The third party processor 20 can be in communication electronically with a third party data storage. The third party data processor 20 can receive sensor information from at least one downhole sensor 24 in the wellbore 26.

A drilling rig 18 can be fluidly connected from the wellbore 26 to a gas trap 52, which can be in fluid communication with a flow meter 44. Fluid samples 50 can flow through a conduit 48 to a total hydrocarbon analyzer 42 for fluid analysis. The total hydrocarbon analyzer can be in electronic communication with the first network 14 conveying total hydrocarbon analyzer fluid testing information 53 to the well fluid processor 10.

The gas trap in an embodiment can include an agitator, such as a maintenance free agitator or another device for sampling drilling fluids from a wellbore that is fluidly connected to the wellbore 26, such as gas traps sold by Selman and Associates of Odessa, Tex.

The well fluid processor can communicate electronically with a mass spectrometer 28 through the first network 14.

The mass spectrometer 28 can have a mass spectrometer processor with mass spectrometer data storage and computer instructions in the mass spectrometer data storage.

Mass spectrometer 28 can receive positive pressure fluid samples 51 from the total hydrocarbon analyzer, perform additional fluid analysis and transmit mass spectrometer fluid testing data 55 to the well fluid processor 10

The processors for the mass spectrometer, total hydrocarbon analyzers, the third party processor and well fluid processor can be computers, microcomputers, laptops, servers, or similar computer data processing devices that communicate via a network such as tablet computers and smart phones.

The first network 14, in embodiments, can be one, two or more connected networks, such as cellular networks, the Internet, satellite networks, or combinations of these types of networks. In embodiments the network can be a local area network or a wide area network. The second network can be identical to the first network.

The system can include a remote processor 54 connected to the second network 15 that communicates to the first network 14. The remote processor can be a computer or device similar to the processor of the third party processor. The remote processor can have a remote data storage which can contain engineering information.

The remote data storage in embodiments can contain computer instructions and other well event based observation information.

The mass spectrometer can communicate with the well fluid processor through the first network to send fluid testing data to the well fluid data storage.

The well fluid processor can further communicate with one or more client devices 34*a* and 34*b* connected to the network 14.

Each client device 34*a* and 34*b* can include a client device processor in communication with a client device data storage connected to a client device display 40*a* and 40*b*.

Client device 34*a* can be a cell phone with a client device display 40*a* showing first alarm 62 as a giant "alarm over an image of a sun" and a second alarm 64 as a giant word "STOP" in a box.

Client device 34*b* can be a client device display connected to a computer. The client device display 40*b* shows a formed geochemical surface well log 400 according to the embodiments.

All the client devices can be computers in an embodiment. All the client devices can be tablet computers, smart phones, or similar portable communicating and processing devices in another embodiment.

The alarms can be generated by computer instructions in the well data storage.

The client devices can each have a client device processor and client device data storage. The client device data storage can contain a plurality of computer instructions and various data values, including but not limited to user information.

In embodiments, the well fluid processor 10 can communicate not only with the total hydrocarbon analyzer 42, and the flow meter 44, but also with a gas chromatograph 46, a hydrogen sulfide sensor 68 and a carbon dioxide sensor 66.

The gas chromatograph 46, hydrogen sulfide sensor 68 and carbon dioxide sensor 66 can be in communication to the fluid samples 50.

The well processor can receive and store the analyzed fluid sample information from these instruments for presenting the analyzed fluid testing information into a geochemical well log template that then forms the geochemical surface well log.

The mass spectrometer 28, total hydrocarbon analyzer 42, flow meter 44 and gas chromatograph 46 can be connected to a sample conduit 48 containing fluid samples 50 which can be gas samples from the wellbore 26.

Figure 2:
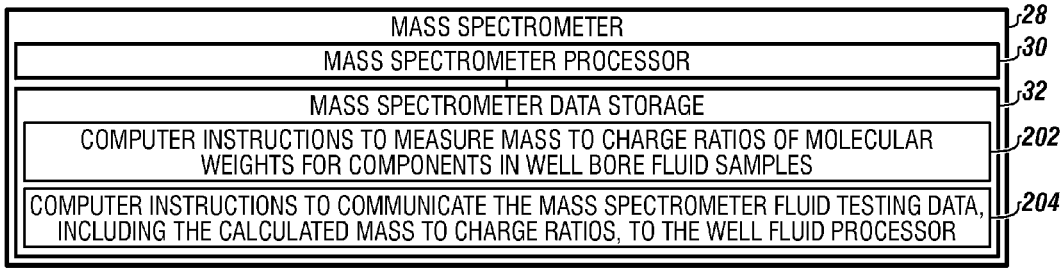
FIG. 2 depicts the mass spectrometer with mass spectrometer data storage.

FIG. 2 shows the mass spectrometer 28 with a mass spectrometer processor 30 which can be a computer.

The mass spectrometer processor 30 can communicate to a mass spectrometer data storage 32, which can be memory of a computer that has the processor 30

The mass spectrometer data storage can include computer instructions 202 to measure mass to charge ratios of molecular weights for components in wellbore fluid samples.

The mass spectrometer data storage can also include computer instructions 204 to communicate the mass spectrometer fluid testing data, including the calculated mass to charge ratios, to the well fluid processor.

Figure 3A:
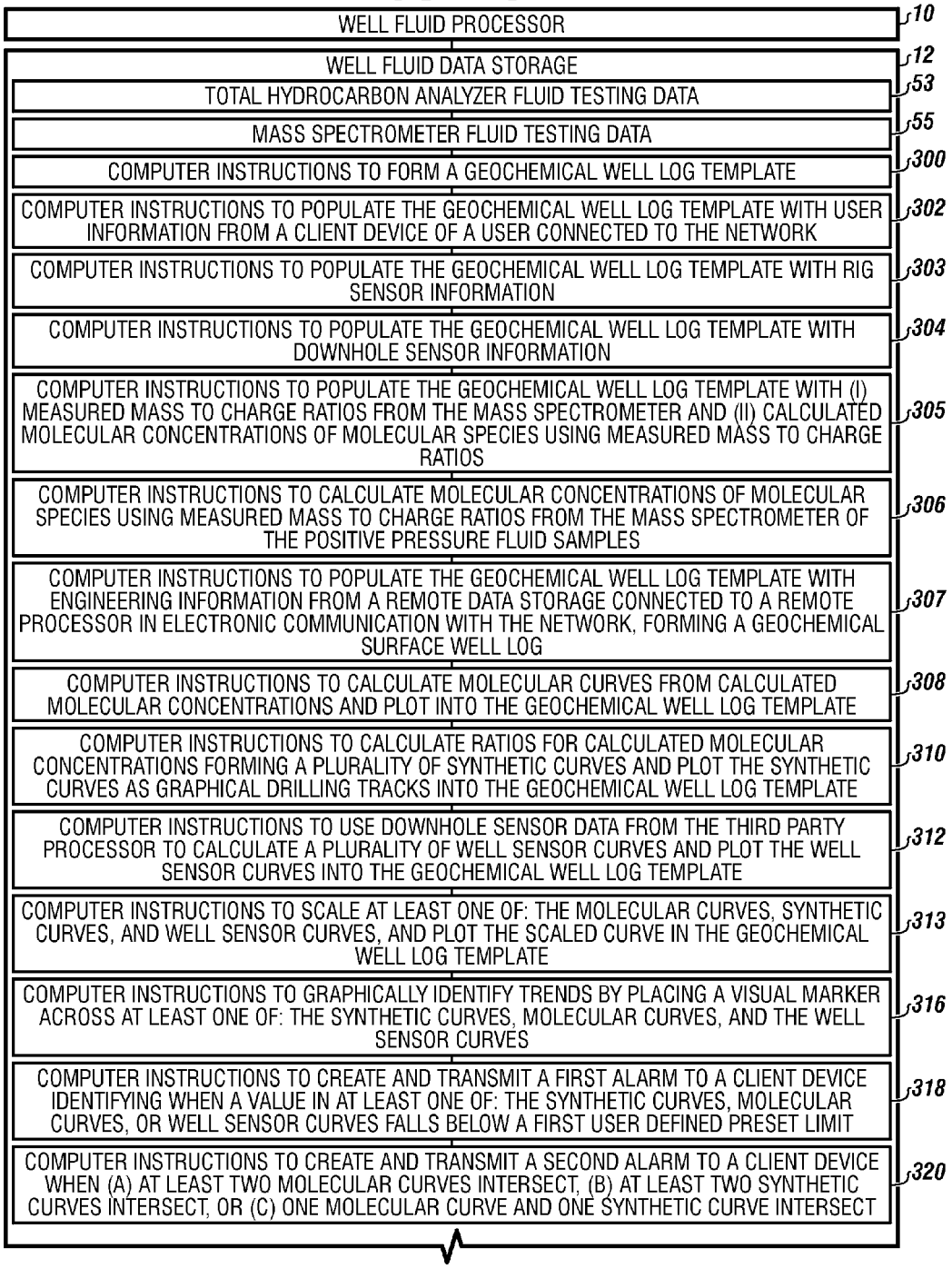
FIGS. 3A-3C depicts the well fluid data storage containing computer instructions which are implemented by the well fluid processor.
Figure 3B:
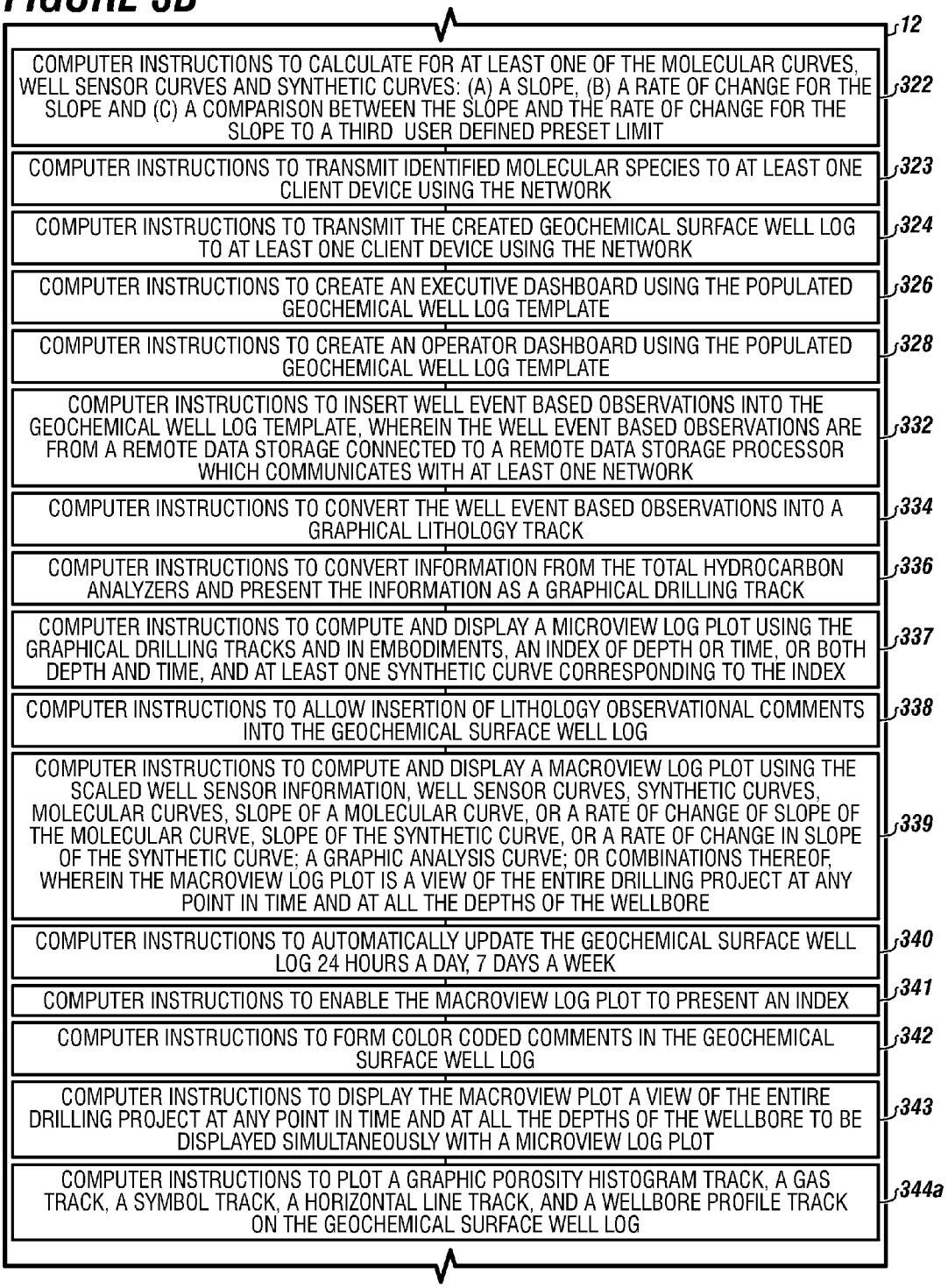
Figure 3C:
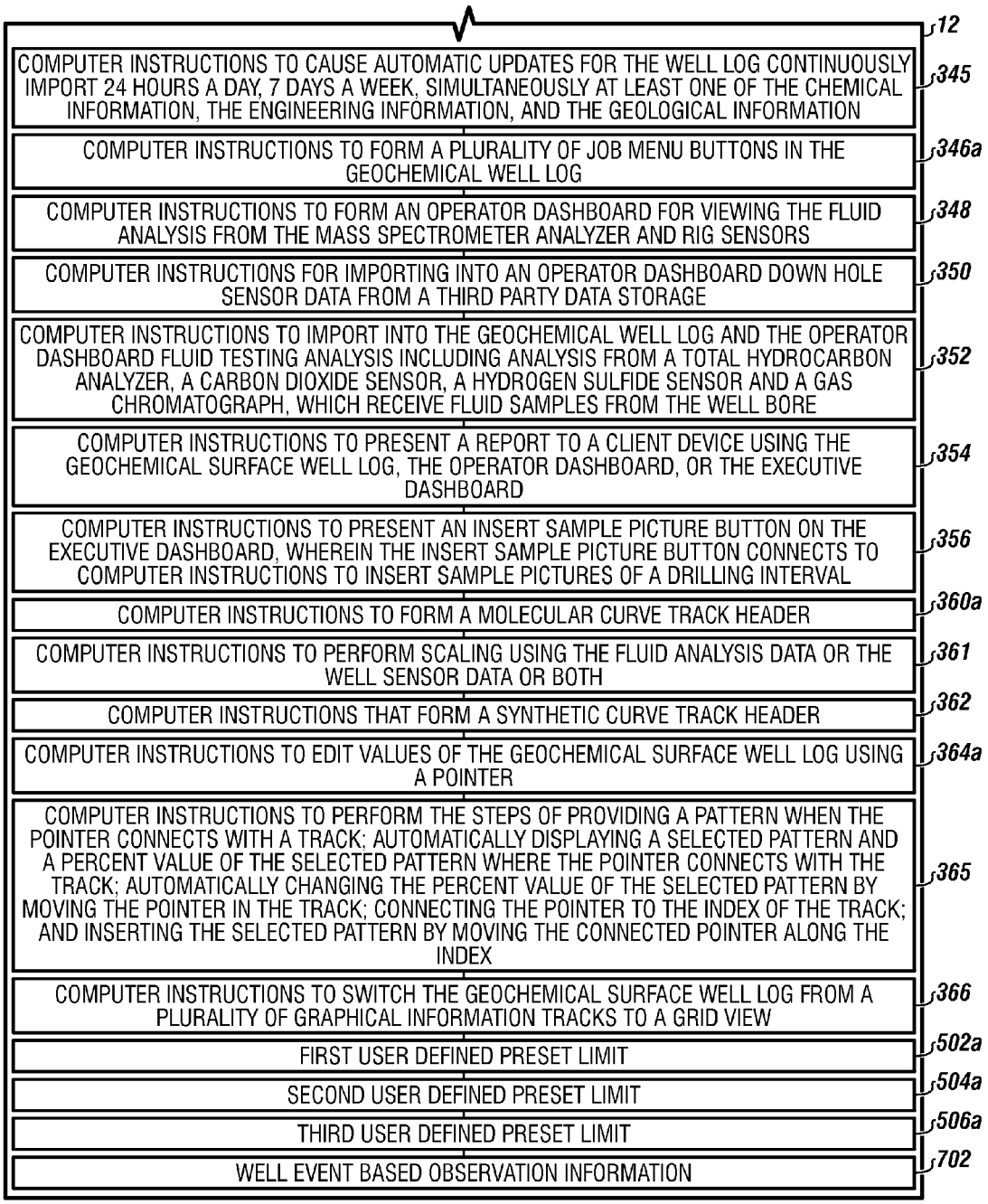

FIG. 3A-3C depict a well fluid data storage 12 in communication with a well fluid processor 10.

The well fluid data storage can include total hydrocarbon analyzer fluid testing data 53.

The well fluid data storage can include mass spectrometer fluid testing data 55.

The well fluid data storage can include computer instructions 300 to form a geochemical well log template.

The well fluid data storage can include computer instructions 302 to populate the geochemical well log template with user information from a client device of a user connected to the network.

The well fluid data storage can include computer instructions 303 to populate the geochemical well log template with rig sensor information.

The well fluid data storage can include computer instructions 304 to populate the geochemical well log template with downhole sensor information.

The well fluid data storage can include computer instructions 305 to populate the geochemical well log template with (i) measured mass to charge ratios from the mass spectrometer and (ii) calculated molecular concentrations of molecular species using measured mass to charge ratios.

The well fluid data storage can include computer instructions 306 to calculate molecular concentrations of molecular species using measured mass to charge ratios from the mass spectrometer of the positive pressure fluid samples.

The well fluid data storage can include computer instructions 307 to populate the geochemical well log template with engineering information from a remote data storage connected to a remote processor in electronic communication with the network, forming a geochemical surface well log.

The well fluid data storage can include computer instructions 308 to calculate molecular curves from calculated molecular concentrations and plot into the geochemical well log template.

The well fluid data storage can include computer instructions 310 to calculate ratios for calculated molecular concentrations forming a plurality of synthetic curves and plot the synthetic curves as graphical drilling tracks into the geochemical well log template.

The well fluid data storage can include computer instructions 312 to use downhole sensor data from the third party processor to calculate a plurality of well sensor curves and plot the well sensor curves into the geochemical well log template.

The well fluid data storage can include computer instructions 313 to scale at least one of: the molecular curves, synthetic curves, and well sensor curves, and plot the scaled curve in the geochemical well log template.

The well fluid data storage can include computer instructions 316 to graphically identify trends by placing a visual marker across at least one of: the synthetic curves, molecular curves, and the well sensor curves.

The well fluid data storage can include computer instructions 318 to create and transmit a first alarm to a client device identifying when a value in at least one of: the synthetic curves, molecular curves, or well sensor curves falls below a first user defined preset limit.

The well fluid data storage can include a first user defined preset limit 502*a* for use with the first alarm for use with a synthetic curve, molecular curve, or well sensor curve.

The well fluid data storage can include computer instructions 320 to create and transmit a second alarm to a client device when (a) at least two molecular curves intersect, (b) at least two synthetic curves intersect, or (c) one molecular curve and one synthetic curve intersect.

The well fluid data storage can include computer instructions 323 to transmit identified molecular species to at least one client device using the network.

The well fluid data storage can include a second user defined preset limit 504*a* for use with the second alarm when the synthetic curves, molecular curves or one synthetic curve and one molecular curve intersect.

The well fluid data storage can include computer instructions 322 to calculate for at least one of the molecular curves, well sensor curves and synthetic curves: (a) a slope, (b) a rate of change for the slope and (c) a comparison between the slope and the rate of change for the slope to a third user defined preset limit.

The well fluid data storage can include a third user defined preset limit 506*a*.

The well fluid data storage can include computer instructions 324 to transmit the created geochemical surface well log to at least one client device using the network.

The well fluid data storage can include computer instructions 326 to create an executive dashboard using the populated geochemical well log template.

The well fluid data storage can include computer instructions 328 to create an operator dashboard using the populated geochemical well log template.

The well fluid data storage can include computer instructions 332 to insert well event based observations into the geochemical well log template, wherein the well event based observations are from a remote data storage connected to a remote data storage processor which communicates with at least one network.

The well fluid data storage can include computer instructions 334 to convert the well event based observations into a graphical lithology track.

The well fluid data storage can include computer instructions 336 to convert information from the total hydrocarbon analyzers and present the information as a graphical drilling track.

These computer instructions 336 can include instructions to present analysis from the mass spectrometer as a separate graphical drilling track.

The well fluid data storage can include computer instructions 337 to compute and display a microview log plot using the graphical drilling tracks and in embodiments, an index of depth or time, or both depth and time, and at least one synthetic curve corresponding to the index.

The well fluid data storage can include computer instructions 338 to allow insertion of lithology observational comments into the geochemical surface well log.

The well fluid data storage can include computer instructions 339 to compute and display a macroview log plot using the scaled well sensor information, well sensor curves, synthetic curves, molecular curves, slope of a molecular curve, or a rate of change of slope of the molecular curve, slope of the synthetic curve, or a rate of change in slope of the synthetic curve; a graphic analysis curve; or combinations thereof, wherein the macroview log plot is a view of the entire drilling project at any point in time and at all the depths of the wellbore.

The well fluid data storage can include computer instructions 340 to automatically update the geochemical surface well log 24 hours a day, 7 days a week.

The well fluid data storage can include computer instructions 341 to enable the macroview log plot to present an index.

The well fluid data storage can include computer instructions 342 to form color coded comments in the geochemical surface well log.

The well fluid data storage can include computer instructions 343 to display the macroview plot a view of the entire drilling project at any point in time and at all the depths of the wellbore to be displayed simultaneously with a microview log plot.

The simultaneous display of the microview and macroview log plots enable safety interpretations for drilling, geological interpretations for drilling, operational interpretations for drilling, and combinations of these interpretations, in near real time in less than 3 hours from obtaining the sensed data for viewing by multiple client devices connected to the network simultaneously.

The well fluid data storage can include computer instructions 344*a* to plot a graphic porosity histogram track, a gas track, a symbol track, a horizontal line track, and a wellbore profile track on the geochemical surface well log.

The well fluid data storage can include computer instructions 345 to cause automatic updates for the well log continuously import 24 hours a day, 7 days a week, simultaneously at least one of the chemical information, the engineering information, and the geological information.

The colors can be selected to separately indicate: a trend identification; at least one drill pipe connection; a survey comments to authenticate actual survey information or reference actual survey information; a drilling parameter; other well fluid related information; a gas peak indicated as a text value on the top of each total gas peak; one or more pieces of faulty equipment; a dated depth; a gas show; and combinations thereof.

The well fluid data storage can include computer instructions 346*a* to form a plurality of job menu buttons in the geochemical well log.

The job menu buttons can connect to computer instructions that enable the user in the well log to create a new job; open an existing job; restore a job from backup; close an open job; import well fluid testing data, import well sensor information, or combinations thereof; export data from the executive dashboard including a portion of the well log in a graphical format, export data from the executive dashboard including a portion of the well log in a digital format, or export data from the executive dashboard in both formats simultaneously; print a well log; edit preferences; and exit.

The well fluid data storage can include computer instructions 348 to form an operator dashboard for viewing the fluid analysis from the mass spectrometer analyzer and rig sensors.

The well fluid data storage can include computer instructions 350 for importing into an operator dashboard downhole sensor data from a third party data storage.

The well fluid data storage can include computer instructions 352 to import into the geochemical well log and the operator dashboard fluid testing analysis including analysis from a total hydrocarbon analyzer, a carbon dioxide sensor, a hydrogen sulfide sensor and a gas chromatograph, which receive fluid samples from the wellbore.

In embodiments, the microview log plot index is a measured depth index; computer instructions to depict a true vertical depth view, wherein the microview log plot index is a true vertical depth index; and computer instructions to depict a vertical section view, wherein the microview log plot index is to a vertical section index.

The well fluid data storage can include computer instructions 354 to present a report to a client device using the geochemical surface well log, the operator dashboard, or the executive dashboard.

These computer instructions 354 can include instructions to present to a user a report management editor that presents a plurality of report choices on an executive dashboard.

The report choices can be create new report; view/edit report; replace a picture to insert a slice of a well log into a report; delete a report from a list of reports; make PDF button; and combinations thereof.

The well fluid data storage can include computer instructions 356 to present an insert sample picture button on the executive dashboard, wherein the insert sample picture button connects to computer instructions to insert sample pictures of a drilling interval.

The well fluid data storage can include computer instructions 360*a* to form a molecular curve track header.

The track header can include at least one of: benzene concentration; toluene concentration; ethyl benzene concentration; xylenes concentration; naphthalenes concentration; naphthenes and cylcloalkane concentration; acetic acid concentration; nitrogen, oxygen, argon, and water vapor concentration; carbon dioxide, helium and hydrogen concentration; sulfer species concentration; methane concentration (C1); ethane concentration (C2); propane concentration (C3); butane concentration (C4); pentane concentration (C5); hexane concentration (C6); heptane concentration (C7); octane concentration (C8); nonane concentrate (C9); and decane concentration (C10).

The well fluid data storage can include computer instructions 362 that form a synthetic curve track header.

The synthetic curve track header in embodiments can include Pixler ratios; wetness balance character ratios, and air to hydrocarbon ratios.

The well fluid data storage can include computer instructions 361 to perform scaling using the fluid analysis data or the well sensor data or both.

The scaling is performed (a) to identify a scale with a minimum and a maximum value; (b) to identify a type of value to be plotted on the scale; (c) to subtract the minimum value from the value to be plotted forming a result and (d) to divide the result by the maximum value of the identified scale versus the minimum value of the identified scale forming a scaled value.

The well fluid data storage can include computer instructions 364*a* to edit values of the geochemical surface well log using a pointer.

The well fluid data storage can include computer instructions 365 to perform the steps of providing a pattern when the pointer connects with a track; automatically displaying a selected pattern and a percent value of the selected pattern where the pointer connects with the track; automatically changing the percent value of the selected pattern by moving the pointer in the track; connecting the pointer to the index of the track; and inserting the selected pattern by moving the connected pointer along the index.

The well fluid data storage can include computer instructions 366 to switch the geochemical surface well log from a plurality of graphical information tracks to a grid view.

Computer instructions 366 can change a grid view of the executive dashboard to a graphic view and computer instructions to form a switch to grid view navigation button on the executive dashboard that connects to computer instructions to change a graphical view of the executive dashboard to a grid view.

The well fluid data storage can include a first user defined preset limit 502*a*, a second user defined preset limit 504*a*, and a third user defined preset limit 506*a*.

The well fluid data storage can include well event based observation information 702.

Figure 4A:
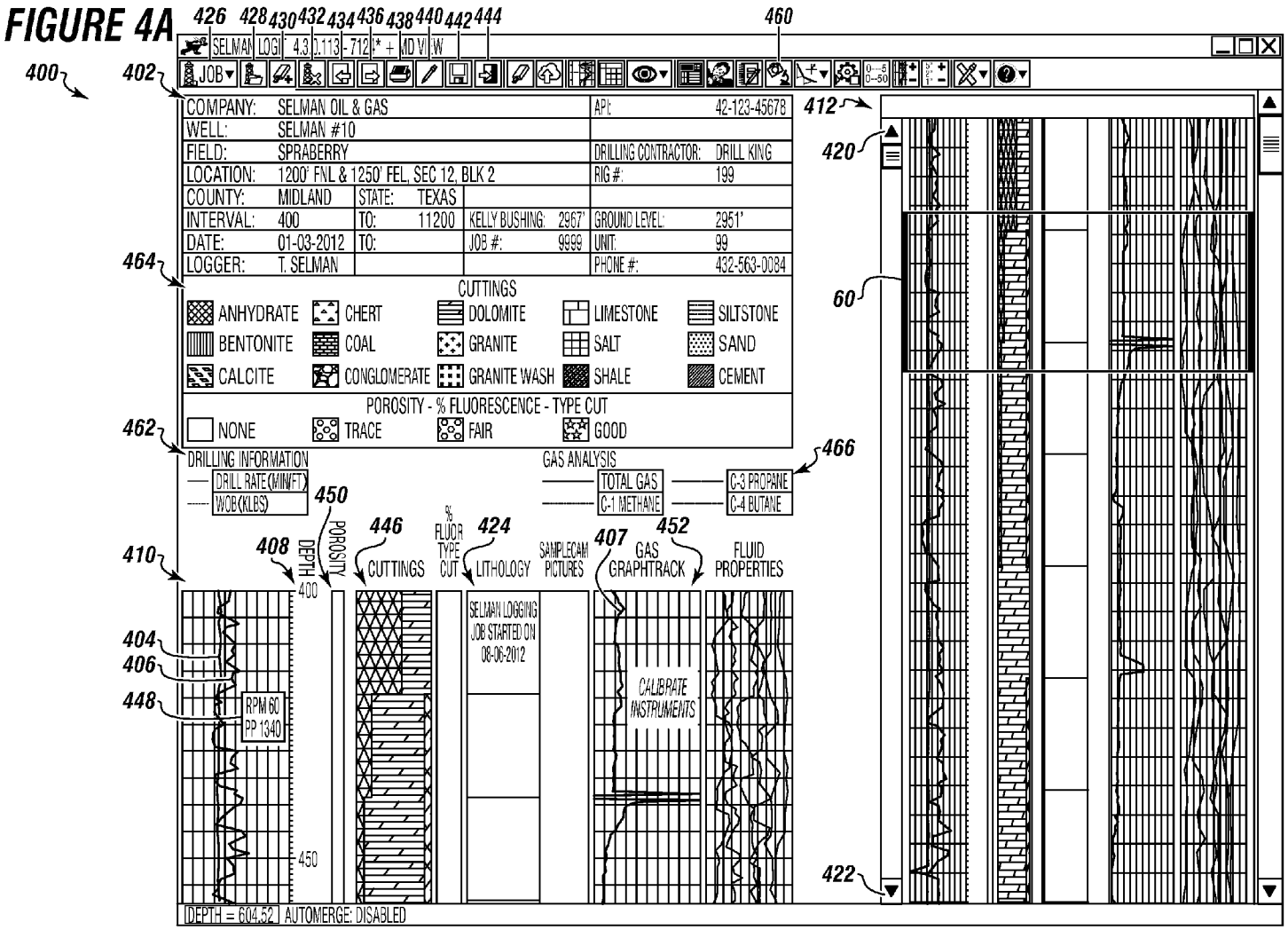
FIG. 4A depicts an executive dashboard using the populated geochemical well log template according to one or more embodiments.

FIG. 4A shows an executive dashboard 400 usable to form a geochemical well surface log. The geochemical well log has molecular curves and synthetic curves shown.

The executive dashboard 400 can present user information 402 and well sensor information 404, engineering information 406, and fluid testing information 407 in either a vertical or horizontal orientation using a measured depth index 408, a microview log plot 410 and a macroview lot plot 412.

User information 402 from a client device can be transmitted into geochemical surface well log. The user information can include company name, well name, field, location, county, logging interval from start to finish, date of logging and logger name.

The user can scroll data tracks using a scroll down button 422, and a scroll up button 420.

A trend can be identified in the well log using a visual marker 60 across at least one of: the synthetic curve, the molecular curves, and the well sensor curves.

The geochemical surface well log can have a macroview plot log and microview plot log displayed simultaneously on the geochemical surface well log in this embodiment.

The well log contains well event based observational data comprising lithology analysis 424 and drill cuttings analysis 446.

Comments 448 such as a pump pressure of 1340, a weight on bit of 150 kilopounds, and an rpm of 60, can be shown on the executive dashboard.

The executive dashboard can continuously import 24 hours a day, 7 days a week, simultaneously at least one of molecular curves, synthetic curves, well sensor curves, engineering data, and geological information including lithology observational comments.

In embodiments, the comments can be color coded, wherein the colors are selected to separately indicate at least one of: a trend identification; at least one drill pipe connection; survey comments to authenticate actual survey information or reference actual survey information; a drilling parameter; a gas peak indicated as a text value on the top of each total gas peak; at least one piece of faulty equipment; a dated depth; and a gas show.

The executive dashboard can include a porosity histogram track 450; a gas graph track 452; a symbol track (not shown); a horizontal line track; and a wellbore profile track (not shown).

The executive dashboard can include in embodiments, a plurality of job buttons on the geochemical surface well log comprising at least one of: create a new job 426; open an existing job 428; restore a job from backup 430; close an open job 432; import data 434 from at least one of: well fluid testing data, and well sensor information; export data 436; print the geochemical surface well log 438; edit the geochemical surface well log 440; save 442; and exit 444.

The executive dashboard can include, in embodiments, a sample picture 460.

The geochemical surface well log in embodiments can include a track header 462 which can be for all of the curves or single molecular curves. The track header can have at least one of: benzene concentration; toluene concentration; ethyl benzene concentration; xylenes concentration; naphthalene concentration; naphthene and cylcloalkane concentration; acetic acid concentration; nitrogen, oxygen, argon, and water vapor concentration; carbon dioxide, helium and hydrogen concentration; sulfur species concentration; methane concentration (C1); ethane concentration (C2); propane concentration (C3); butane concentration (C4); pentane concentration. (C5); hexane concentration (C6); heptane concentration (C7); octane concentration (C8); nonane concentrate (C9); and decane concentration (C10).

The header section can include information that identifies the owner of the associated well, where the associated well is located, the phone number, a date the well log was created can be included, a depth interval range can be depicted as well with starting and ending depths.

The executive dashboard can include patterns 464 such as repeated circles, or cross hatching in the graphical drilling tracks to depict a percent rock in each track.

The executive dashboard can also include a legend 466 in the track header.

A visual marker 60 indicating a trend can be installed on the graphic drilling tracks.

FIG. 4B shows a geochemical well log template 401 containing most of the features of the first executive dashboard. A measured time index 409 is depicted instead of the measured depth index.

The microview log plot 410 can have at least one of: a molecular curve 416, a well sensor curve, and a synthetic curve 418.

The macroview log plot 412 can have at least one of: a molecular curve, a well sensor curve, and a synthetic curve; while depicting a compressed a view of the entire drilling project at any point in time and at all the depths of the wellbore.

A plurality of synthetic curves are shown plotted on the geochemical well log template including, a Pixler ratio 468; a wetness ratio 469, balance ratio 470, character ratio 471, and an air to hydrocarbon ratio 472.

The geochemical surface well log can be editable by a pointer and providing a pattern when the pointer connects with a track; automatically displays a selected pattern and a percent value of the selected pattern where the pointer connects with the track; automatically changing the percent value of the selected pattern by moving the pointer in the track; connecting the pointer to the index of the track; and inserting the selected pattern by moving the connected pointer along the index.

The geochemical surface well log can be shown as a plurality of graphical information tracks to a grid view.

Trends are identified in the well log using a visual markers 60 across at least one of: the synthetic curve, the molecular curves, and the well sensor curves.

The geochemical well log template has scroll down button 422, and a scroll up button 420.

A sample picture button 460 for inserting sample pictures into the geochemical well log template is also depicted.

A track header 462 is also shown.

A porosity histogram track 450 is depicted.

Drill cuttings analysis 446 and comments 448 are in the geochemical well log template.

The geochemical well log template can have a macroview plot log and microview plot log displayed simultaneously on the geochemical surface well log in embodiments.

The well log contains well event based observational data comprising lithology analysis and drill cuttings analysis from a remote data storage.

Well event based observational data is displayed in the well log as a lithology track and drill cuttings analysis from the mass spectrometer and a total hydrocarbon analyzer are depicted as a graphical drill cuttings track.

Lithology observational comments 414 are inserted into the geochemical surface well log.

The geochemical surface well log continuously imports 24 hours a day, 7 days a week, simultaneously at least one of molecular curves, synthetic curves, well sensor curves, engineering data, geological information including lithology observational comments.

In embodiments, color coded comments are used wherein the colors are selected to separately indicate at least one of: a trend identification; at least one drill pipe connection; survey comments to authenticate actual survey information or reference actual survey information; a drilling parameter; a gas peak indicated as a text value on the top of each total gas peak; at least one piece of faulty equipment; a dated depth; and a gas show.

The geochemical surface well log includes in embodiments, a plurality of job buttons on the geochemical surface well log comprising at least one of: create a new job 426; open an existing job 428; restore a job from backup 430; close an open job 432;

import data 434 comprising at least one of: well fluid testing data, and well sensor information; export data 436 from geochemical surface well log; print the geochemical surface well log 438; edit the geochemical surface well log 440; save 442; and exit 444.

The geochemical surface well log in embodiments can include a sample picture in the geochemical surface well log.

The geochemical surface well log in embodiments includes a track header 462 for the molecular curves, wherein the track header can have at least one of: benzene concentration; toluene concentration; ethyl benzene concentration; xylenes concentration; naphthalenes concentration; naphthenes and cylcloalkane concentration; acetic acid concentration; nitrogen, oxygen, argon, and water vapor concentration; carbon dioxide, helium and hydrogen concentration; sulfer species concentration; methane concentration (C1); ethane concentration (C2); propane concentration (C3); butane concentration (C4); pentane concentration (C5); hexane concentration (C6); heptane concentration (C7); octane concentration (C8); nonane concentrate (C9); and decane concentration (C10).

The header section can include information that identifies the owner of the associated well, where the associated well is located, the name of the entity requesting the well log, the phone number of the person requesting the well a date the well log was created can be included.

The well log can include patterns, such as repeated circles, or cross hatching in the graphical drilling tracks to depict a percent rock in each track.

The well log can include a legend 466 and a gas analysis lag time section 435.

The gas analysis lag time section includes data related to the composition of detected gasses at different depths of the wellbore. The gas analysis lag time section can include lag time data relating to other drilling operation properties.

A synthetic curve track header 433 for the synthetic curves can be in the well log which can include Pixler ratios, a wetness balance character ratios, and an air to hydrocarbon ratio.

The geochemical surface well log can be editable by a pointer and providing a pattern when the pointer connects with a track; automatically displays a selected pattern and a percent value of the selected pattern where the pointer connects with the track; automatically changing the percent value of the selected pattern by moving the pointer in the track; connecting the pointer to the index of the track; and inserting the selected pattern by moving the connected pointer along the index.

The geochemical surface well log can be shown as a plurality of graphical information tracks to a grid view.

Figure 5:
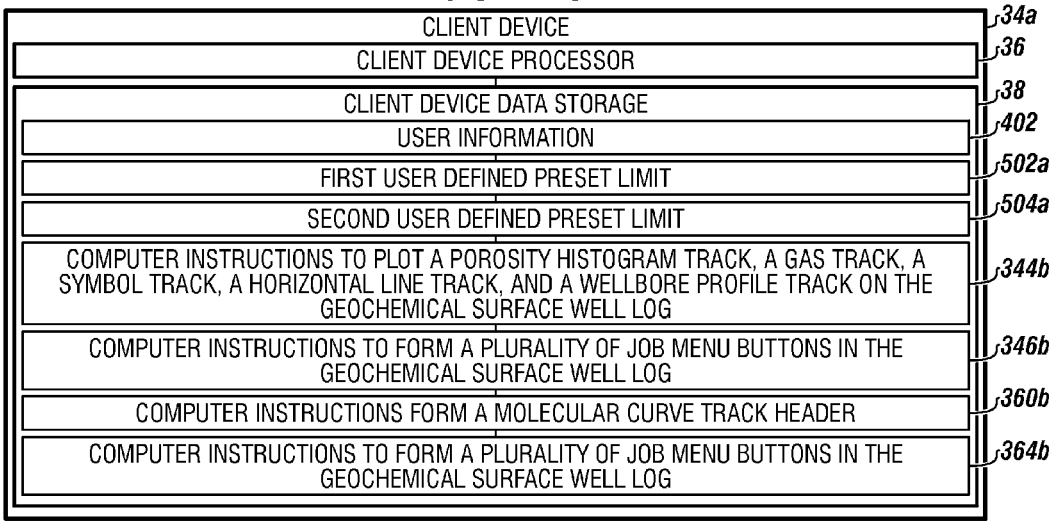
FIG. 5 depicts a client device data storage in communication with a client device processor.

FIG. 5 shows a client device data storage 38 in communication with a client device processor 36 contained within a client device 34*a*.

The client device data storage can include user information 402, first user defined preset limit 502*a*, a second user defined preset limit 504*a*, and computer instructions 344*b* to plot a porosity histogram track, a gas track, a symbol track, a horizontal line track, and a wellbore profile track on the geochemical surface well log.

The client device data storage can include computer instructions 346*b* to form a plurality of job menu buttons in the geochemical surface well log, wherein each button connects to computer instructions that provide different job functionalities, as listed earlier.

The client device data storage can include computer instructions 360*b* form a molecular curve track header.

The client device data storage can include computer instructions 364*b* to edit values of the geochemical surface well log using a pointer.

Figure 6:
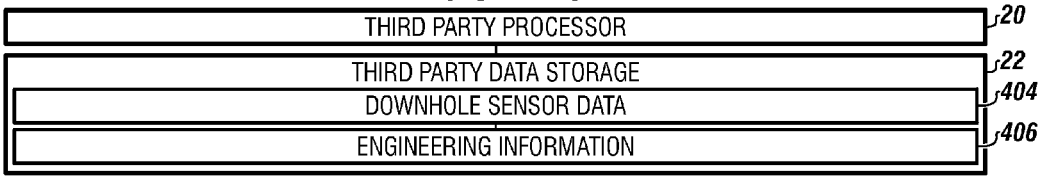
FIG. 6 depicts a third party data storage in communication with a third party processor.

FIG. 6 depicts a third party data storage 22 connected to a third party processor 20.

The third party data storage can include downhole sensor data 404 and engineering information 406.

Figure 7:
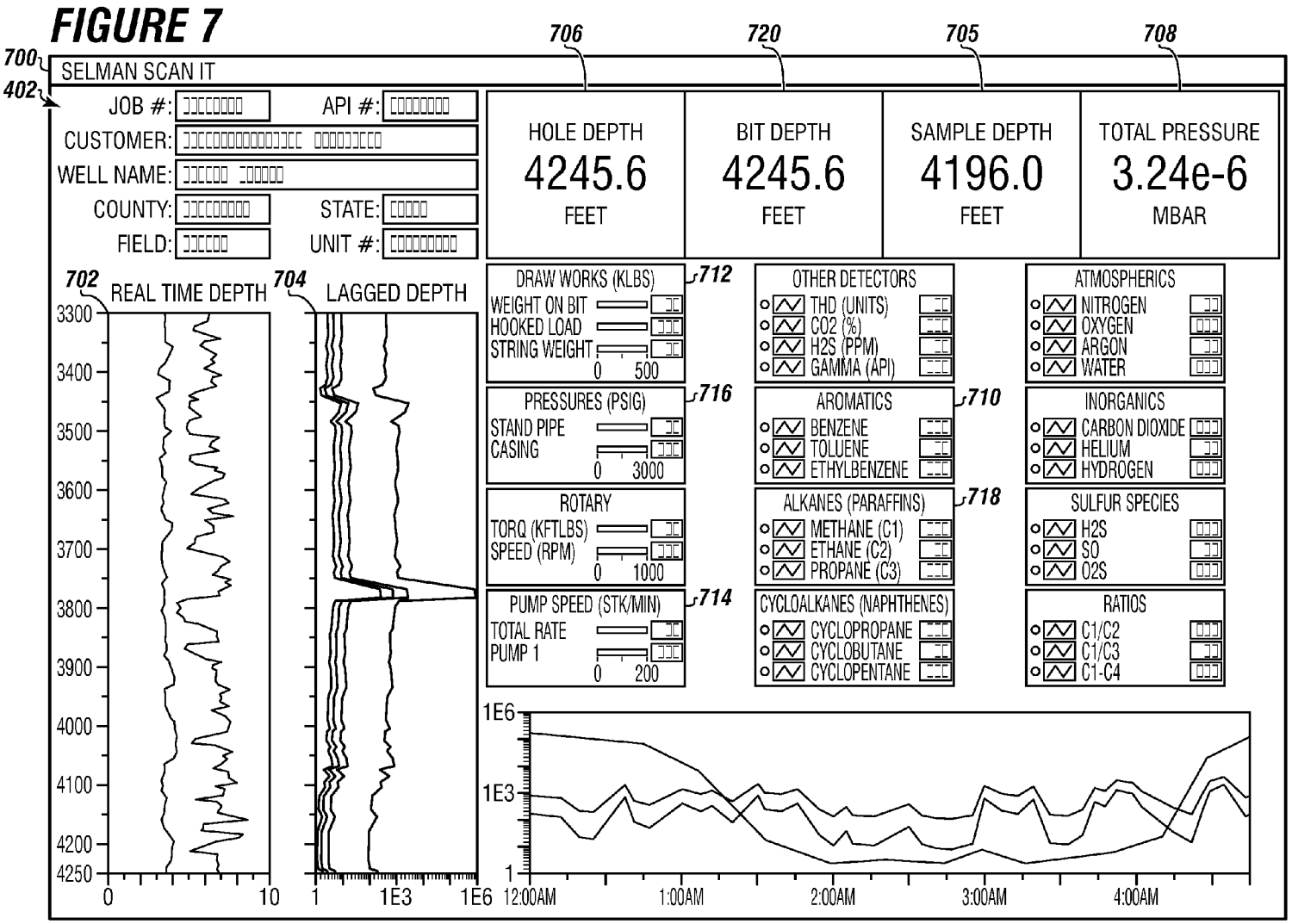
FIG. 7 depicts an operator dashboard formed by the method.

FIG. 7 shows an exemplary embodiment of an executive dashboard usable to create the well log.

FIG. 7 shows an operator dashboard usable with an embodiment of the method.

An operator dashboard 700 enables an operator to view analysis from (i) the mass spectrometer analyzer, and (ii) at least one rig sensor to present: a real time depth graphical display 702; a lag depth graphical display 704; a lag depth digital display 705; a hole depth 706; a mass spectrometer reaction chamber pressure 708; a current value of an analyzed component of a fluid sample 710, shown in this Figure as benzene at 153 ppm. Also shown is well sensor information 712 such as a weight on bit sensor showing a reading of 100 kilopounds.

Pump speed 714 and pump pressure 716 can be shown on the operator dashboard.

The molecular curves, the synthetic curves and the well sensor curves can be graphically presented on the operator dashboard, toluene is shown as element 718.

User information 402 is shown. Additional geological information, such as bit depth 720 is depicted. All of the information can be simultaneously shown on the executive dashboard.

Figure 8:
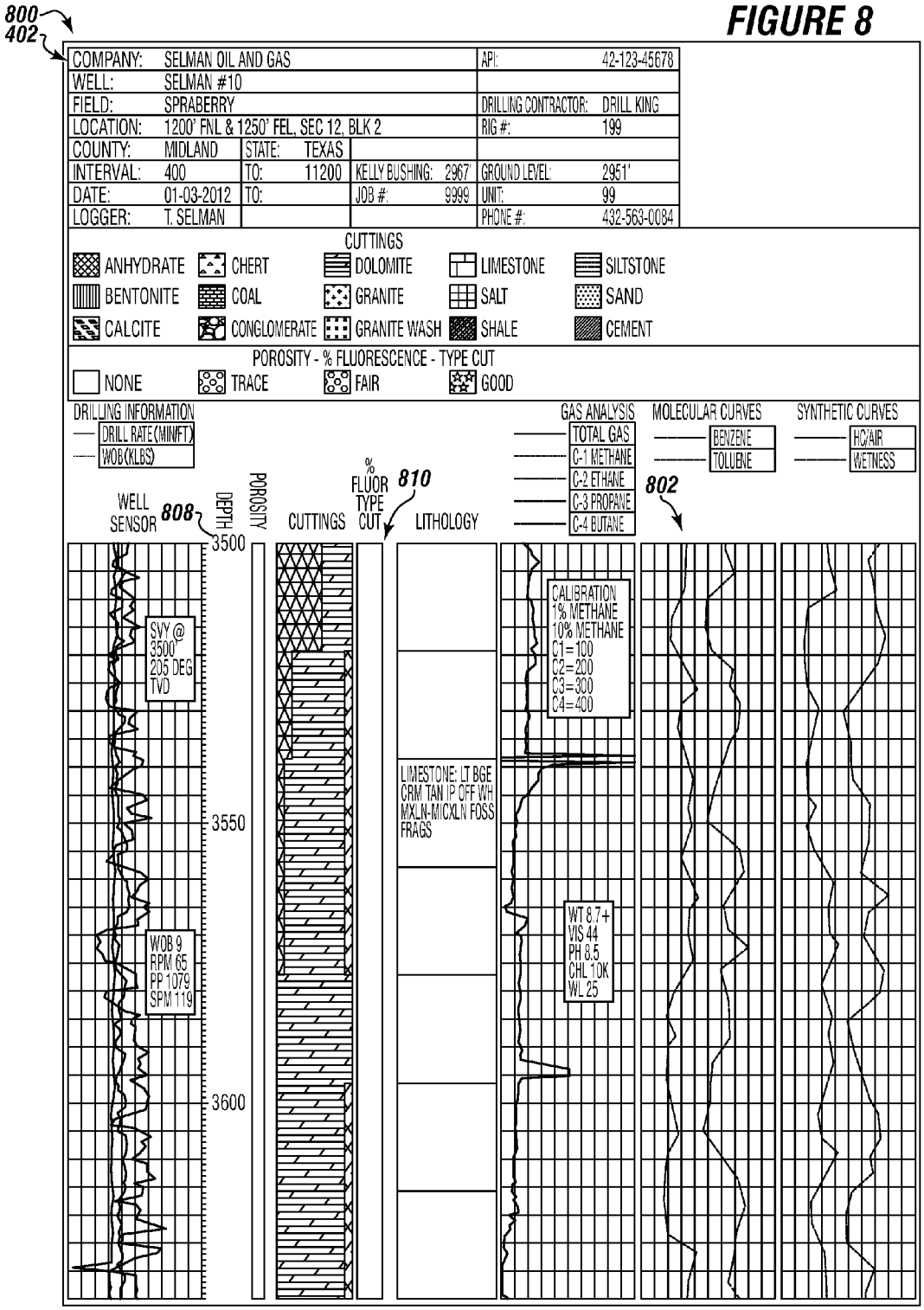
FIG. 8 depicts an exemplary geochemical surface well log formed by the method.

FIG. 8 shows a geochemical surface well log 800.

The geochemical surface well log presents user information 402 and well sensor information, engineering information, and fluid testing information in either a vertical or horizontal orientation using a measured depth index 808, a true vertical depth index 810 or a vertical section index and depicting at least one of: a microview log plot 802 and a macroview lot plot, with: the microview log plot 802 comprising: at least one of: a molecular curve, a well sensor curve, and a synthetic curve; and at least one of a measured depth index 808 and a measured time index; the macroview log plot comprising: at least one of: a molecular curve, a well sensor curve, and a synthetic curve; and a compressed a view of the entire drilling project at any point in time and at all the depths of the wellbore.

The geochemical surface well log of the present embodiments can be imported into computer instructions for geosteering while drilling a well.

The molecular curves, the synthetic curves and the well sensor curves as graphically presented can be inserted into a type log consisting of well sensor data, user data, lithology, geochemical data, which can be compared to a horizontal well being drilled in near real time to alter the direction of the drill bit, while the well is being drilled for economic and safety reasons.

Figure 9A:
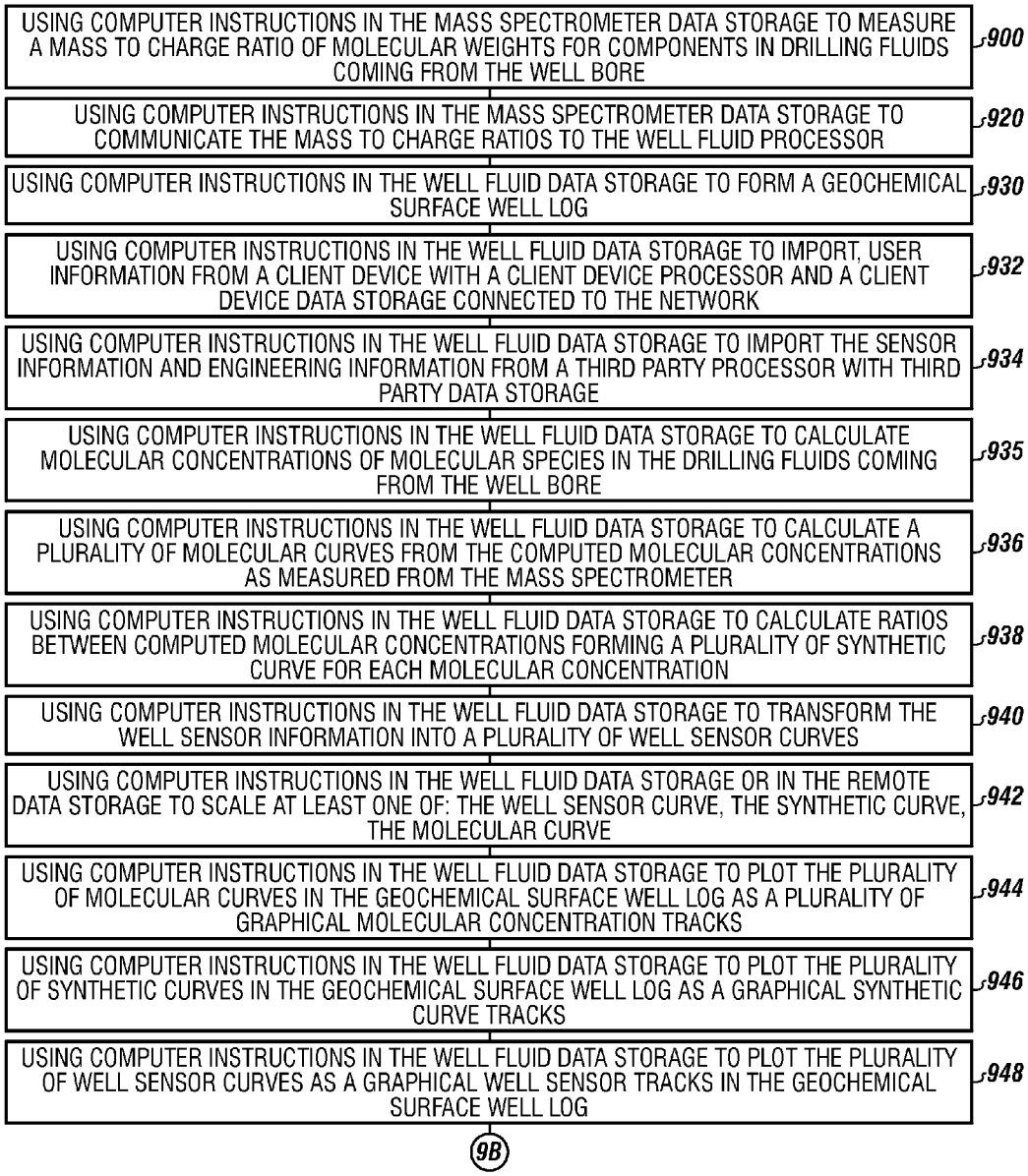

FIGS. 9A and 9B depict the steps implemented by the method.

The method can include using computer instructions in the mass spectrometer data storage to measure a mass to charge ratio of molecular weights for components in drilling fluids coming from the wellbore, as shown in step 900.

The method can include using computer instructions in the mass spectrometer data storage to communicate the mass to charge ratios to the well fluid processor, as shown in step 920.

The method can include using computer instructions in the well fluid data storage to form a geochemical surface well log, as shown in step 930.

The method can include using computer instructions in the well fluid data storage to import user information from a client device with a client device processor and a client device data storage connected to the network, as shown in step 932.

The method can include using computer instructions in the well fluid data storage to import the sensor information and engineering information from a third party processor with third party data storage, as shown in step 934.

The method can include using computer instructions in the well fluid data storage to calculate molecular concentrations of molecular species in the drilling fluids coming from the wellbore, as shown in step 935.

The method can include using computer instructions in the well fluid data storage to calculate a plurality of molecular curves from the computed molecular concentrations as measured from the mass spectrometer, as shown in step 936.

The method can include using computer instructions in the well fluid data storage to calculate ratios between computed molecular concentrations forming a plurality of synthetic curve for each molecular concentration, as shown in step 938.

The method can include using computer instructions in the well fluid data storage to transform the well sensor information into a plurality of well sensor curves, as shown in step 940.

The method can include using computer instructions in the well fluid data storage or in the remote data storage to scale at least one of: the well sensor curve, the synthetic curve, the molecular curve, as shown in step 942.

The method can include using computer instructions in the well fluid data storage to plot the plurality of molecular curves in the geochemical surface well log as a plurality of graphical molecular concentration tracks, as shown in step 944.

The method can include using computer instructions in the well fluid data storage to plot the plurality of synthetic curves in the geochemical surface well log as a graphical synthetic curve tracks, as shown in step 946.

The method can include using computer instructions in the well fluid data storage to plot the plurality of well sensor curves as a graphical well sensor tracks in the geochemical surface well log, as shown in step 948.

The method can include using computer instructions to identify trends by performing at least one of the following: (a) graphically identifying trends in the well log by placing visual markers across at least one of: the graphical molecular concentration track, the graphical synthetic curve track, and the graphical well sensor track; (b) create and transmit a first alarm identifying when a value in at least one of: the graphical molecular concentration track, graphical synthetic curve track, and the graphical well sensor track; exceeds or falls below a first user defined preset limit stored in at least one: the well fluid data storage, and a client device data storage; (c) create and transmit a second alarms identifying when at least two molecular curves intersect; at least two synthetic curves intersect; or at least one molecular curve and at least one synthetic curve intersect, as shown in step 950;

The method can include using computer instructions in the well fluid data storage to: calculate a slope of at least one of; a molecular curve, a well sensor curve, and a synthetic curve, as shown in step 952;

The method can include using computer instructions in the well fluid sever data storage to calculate a rate of change for the calculated slope of at least one of: the molecular curve, well sensor curve, and synthetic curves, as shown in step 954.

The method can include using computer instructions in the well fluid sever data storage compare the calculated slope or the calculated rate of change of slope of at least one of: the molecular curve, well sensor curve and synthetic curve; to a second user defined preset limit in the well fluid data storage to determine if an anomaly is present for a drilling process, for a rock formation, or for a drilling process and a rock formation, as shown in step 956.

The performance of these steps allows the computer instructions to graphically provide in near real time, a geochemical surface well log to a client device for a drilling process of a well to enable safety interpretations for at least one of drilling and economic analysis; geochemical interpretations for at least one of: mapping regionally, mapping locally, timeline modeling of a geological reservoir, economic analysis, and operations; geological interpretations for at least one of: drilling, mapping, modeling, operations, and economic analysis; and engineering interpretations for at least one of: drilling, operations, and economic analysis; in near real time streaming the geochemical surface well log to at least one client device connected to the network.

FIG. 10 depicts a remote processor 54 connected to a remote data storage 57 that contains downhole sensor data 404 and engineering information 406.

While these embodiments have been described with emphasis on the embodiments, it should be understood that within the scope of the appended claims, the embodiments might be practiced other than as specifically described herein.

What is claimed is:

1. A continuous and automatic computer implemented method for analyzing fluids from boreholes in near real time for a geothermal, hydrocarbon, or testing well, using a well fluid processor and communicating the analyzed fluid information to at least one client device using a network, comprising:

a. connecting a total hydrocarbon analyzer to a wellbore to receive wellbore fluid samples and produce positive pressure fluid samples, connecting the total hydrocarbon analyzer to electronically communicate with the network, performing fluid analysis using the total hydrocarbon analyzer on the wellbore fluid samples forming total hydrocarbon analyzer fluid testing data;

b. receiving the formed total hydrocarbon analyzer fluid testing data by the well fluid processor;

c. connecting a mass spectrometer to the total hydrocarbon analyzer to receive the positive pressure fluid samples and to electronically communicate with the network, the mass spectrometer comprising:

i. a mass spectrometer processor;

ii. a mass spectrometer data storage;

iii. computer instructions to measure a mass to charge ratio of molecular weights for components in the wellbore fluid samples forming mass spectrometer fluid testing data; and iv. computer instructions to communicate the mass spectrometer fluid testing data to the well fluid processor;

d. measuring a mass to charge ratio of molecular weights of components for each positive pressure fluid sample using the mass spectrometer forming the mass spectrometer fluid testing data;

e. communicating the mass spectrometer fluid testing data to the well fluid processor using the network;

f. storing the total hydrocarbon analyzer fluid testing data and the mass spectrometer fluid testing data in a well fluid data storage connected to the well fluid processor;

g. using computer instructions in the well fluid data storage to calculate molecular concentrations of molecular species using measured mass to charge ratios from the mass spectrometer of the positive pressure fluid samples;

h. using computer instructions in the well fluid data storage to transmit identified molecular species to the at least one client device using the network;

i. using computer instructions to compute and display well event based observations into the geochemical well log template; and j. using computer instructions in the well fluid data storage to edit values of the geochemical surface well log using a pointer and using computer instructions to perform the steps of:

i. providing a pattern when the pointer connects with a track;

ii. automatically displaying a selected pattern and a percent value of the selected pattern where the pointer connects with the track;

iii. automatically changing the percent value of the selected pattern by moving the pointer in the track;

iv. connecting the pointer to an index of the track; and v. inserting the selected pattern by moving the connected pointer along the index.

2. The continuous and automatic method for analyzing fluids from boreholes in near real time of claim 1, comprising:

a. connecting the well fluid processor to: at least one of:

i. at least one rig sensor on a drilling rig to receive rig sensor information;

ii. a third party processor that receives downhole sensor information from at least one downhole sensor in the wellbore; and iii. a remote processor with a remote data storage containing engineering information on equipment in the wellbore;

b. using computer instructions in the well fluid data storage to create a geochemical well log template;

c. using computer instructions in the well fluid data storage to populate the geochemical well log template with user information from the at least one client device connected to the network;

d. using computer instructions in the well fluid data storage to populate the geochemical well log template with the rig sensor information;

e. using computer instructions in the well fluid data storage to populate the geochemical well log template with the downhole sensor information;

f. using computer instructions in the well fluid data storage to populate the geochemical well log template with (i) measured mass to charge ratios from the mass spectrometer and (ii) calculated molecular concentrations of molecular species using measured mass to charge ratios; and g. using computer instructions in the well fluid data storage to populate the geochemical well log template with the engineering information from the remote data storage connected to the remote processor in electronic communication with the network, forming the geochemical surface well log and transmitting the formed geochemical surface well log to the at least one client device.

3. The continuous and automatic method for analyzing fluids from boreholes in near real time of claim 2, comprising using computer instructions to calculate molecular curves from calculated molecular concentrations and plot the molecular curves into the geochemical well log template.

4. The continuous and automatic method for analyzing fluids from boreholes in near real time of claim 3, comprising using computer instructions in the well fluid data storage to calculate ratios for calculated molecular concentrations forming synthetic curves and plot the synthetic curves into the geochemical well log template.

5. The continuous and automatic method for analyzing fluids from boreholes in near real time of claim 4, comprising using computer instructions in the well fluid data storage to use the downhole sensor information from the third party processor with a third party data storage to calculate well sensor curves and plot the well sensor curves into the geochemical well log template.

6. The continuous and automatic method for analyzing fluids from boreholes in near real time of claim 5, comprising using computer instructions in the well fluid data storage to scale at least one of: the molecular curves, the synthetic curves, and the well sensor curves, and plot the scaled curve in the geochemical well log template.

7. The continuous and automatic method for analyzing fluids from boreholes in near real time of claim 6, further comprising:

a. using computer instructions in the well fluid data storage to allow insertion of lithology observational comments into the geochemical surface well log; and b. using computer instructions in the well fluid data storage to automatically update the geochemical surface well log continuously import 24 hours a day, 7 days a week, comprising at least one of: the molecular curves, the synthetic curves, the well sensor curves, engineering data, geological information including lithology observational comments.

8. The continuous and automatic method for analyzing fluids from boreholes in near real time of claim 5, comprising graphically identifying trends in the geochemical surface well log by at least one of the following:

a. using computer instructions in the well fluid data storage to graphically identify trends by placing a visual marker across at least one of: the synthetic curves, the molecular curves, and the well sensor curves;

b. using computer instructions in the well fluid data storage to create and transmit a first alarm to the at least one client device identifying when a value in at least one of: the molecular curves, the synthetic curves, or the well sensor curves exceeds or falls below a first user defined preset limit, wherein the first user defined preset limit is stored in at least one: the well fluid data storage, and a client device data storage; and c. using computer instructions in the well fluid data storage to create and transmit a second alarm to the at least one client device identifying when:

i. at least two molecular curves intersect;

ii. at least two synthetic curves intersect; or iii. one molecular curve and one synthetic curve intersect.

9. The continuous and automatic method for analyzing fluids from boreholes in near real time of claim 8, comprising using computer instructions in the well fluid data storage to enable:

a. safety interpretations for drilling and economic analysis;

b. geochemical interpretations for at least one of: regional reservoir mapping, local reservoir mapping, timeline modeling of a geological reservoir, economic analysis of a reservoir, and operations concerning the reservoir; and c. engineering interpretations for at least one of: drilling, operations, and economic analysis.

10. The continuous and automatic method for analyzing fluids from boreholes in near real time of claim 5, comprising using computer instructions in the well fluid data storage to calculate for at least one of: the molecular curves, the well sensor curves, and the synthetic curves, at least one of the following:

a. a slope;

b. a rate of change for the slope;

c. a comparison between slopes or between rates of change of the slopes to a second user defined preset limit, wherein the second user defined preset limit is in at least one of: a client device data storage and the well fluid data storage; and using the comparison to determine if an anomaly is present for either: a drilling process, a rock formation, or for a drilling process and a rock formation; thereby creating in near real time, a geochemical surface well log with a plurality of graphical curves.

11. The continuous and automatic method for analyzing fluids from boreholes in near real time of claim 5, comprising using computer instructions to create an operator dashboard that is customizable to present the user information, well sensor information, engineering information, fluid testing information, the molecular curves, the synthetic curves, and the well sensor curves.

12. The continuous and automatic method for analyzing fluids from boreholes in near real time of claim 5, comprising using computer instructions to compute and display a microview log plot in the geochemical well log template, microview log plot comprises at least one of: the molecular curves, the well sensor curves, and the synthetic curves and at least one of: a measured depth index and a measured time index.

13. The continuous and automatic method for analyzing fluids from boreholes in near real time of claim 12, comprising using computer instructions to compute and display a macroview log plot, wherein the macroview log plot comprises at least one of: the molecular curves, the well sensor curves, and the synthetic curves and a compressed view of the entire drilling project at any point in time during drilling and at all the depths of the wellbore.

14. The continuous and automatic method for analyzing fluids from boreholes in near real time of claim 13, comprising using computer instructions to display the macroview log plot and the microview log plot simultaneously on the geochemical surface well log.

15. The continuous and automatic method for analyzing fluids from boreholes in near real time of claim 3, using computer instructions in a client device data storage and the well fluid data storage to form a track header for the molecular curves, wherein the molecular curve track header has at least one of:

a. benzene concentration;

b. toluene concentration;

c. ethyl benzene concentration;

d. xylenes concentration;

e. naphthalene concentration;

f. naphthene and cycloalkane concentration;

g. acetic acid concentration;

h. nitrogen, oxygen, argon, and water vapor concentration;

i. carbon dioxide, helium and hydrogen concentration;

j. sulfur species concentration;

k. methane concentration (C1);

l. ethane concentration (C2);

m. propane concentration (C3);

n. butane concentration (C4);

o. pentane concentration (C5);

P. hexane concentration (C6);

q. heptane concentration (C7);

r. octane concentration (C8);

s. nonane concentrate (C9); and t. decane concentration (C10).

16. The continuous and automatic method for analyzing fluids from boreholes in near real time of claim 4, using computer instructions in the well fluid data storage and a client device data storage in the at least one client device to provide a synthetic curve track header for the synthetic curves, the synthetic curve track header having at least one of:

a. pixler ratios;

b. wetness balance character ratios; and c. an air to hydrocarbon ratio.

17. The continuous and automatic method for analyzing fluids from boreholes in near real time of claim 2, further comprising using computer instructions in at least one of the well fluid data storage and a client device data storage to form a plurality of job buttons that perform specific functions using the geochemical surface well log, the plurality of job buttons comprising at least one of:

a. create a new job;
b. open an existing job;
c. restore a job from backup;
d. close an open job;
e. import data comprising at least one of: well fluid testing data, and well sensor information;
f. export data from geochemical surface well log;
g. print the geochemical surface well log;
h. edit the geochemical surface well log;
i. save; and
j. exit.

18. The continuous and automatic method for analyzing fluids from boreholes in near real time of claim 2, further comprising using computer instructions in the well fluid data storage to form an operator dashboard for viewing analysis from (i) the mass spectrometer analyzer, and (ii) the at least one rig sensor to present: a real time depth graphical display; a lag depth graphical display; a lag depth digital display; a hole depth; a mass spectrometer reaction chamber pressure; a current value of analyzed components of a fluid sample; and well sensor information.

19. The continuous and automatic method for analyzing fluids from boreholes in near real time of claim 18, further comprising using computer instructions for importing the downhole sensor information from the third party data storage into the operator dashboard.

20. The continuous and automatic method for analyzing fluids from boreholes in near real time of claim 18, further comprising importing into the geochemical well log template and the operator dashboard, fluid testing analysis from at least one of: (1) a total hydrocarbon analyzer, (2) a carbon dioxide sensor, (3) a hydrogen sulfide sensor and (4) a gas chromatograph.

21. The continuous and automatic method for analyzing fluids from boreholes in near real time of claim 18, further comprising using computer instructions in the well fluid data storage to present a report to the at least one client device using the geochemical surface well log, the operator dashboard, or an executive dashboard.

22. The continuous and automatic method for analyzing fluids from boreholes in near real time of claim 1, comprising using computer instructions to create an executive dashboard that is customizable to present the user information, well sensor information, engineering information, and fluid testing information in either a vertical orientation or a horizontal orientation using at least one of:

a. a measured depth index;
b. a true vertical depth index; and
c. a vertical section index.

23. The continuous and automatic method for analyzing fluids from boreholes in near real time of claim 1, comprising using computer instructions to convert the well event based observations into a graphical lithology track in the geochemical well log template.

24. The continuous and automatic method for analyzing fluids from boreholes in near real time of claim 1, comprising using computer instructions to compute and display information from the total hydrocarbon analyzer as a graphical drilling track in the geochemical well log template.

25. The continuous and automatic method for analyzing fluids from boreholes in near real time of claim 1, further comprising using computer instructions in the well fluid data storage to form color coded comments, wherein the colors are selected to separately indicate at least one of:

a. a trend identification;
b. at least one drill pipe connection;
c. survey comments to authenticate actual survey information or reference actual survey information;
d. a drilling parameter;
e. a gas peak indicated as a text value on the top of each total gas peak;
f. at least one piece of faulty equipment;
g. a dated depth; and
h. a gas show.

26. The continuous and automatic method for analyzing fluids from boreholes in near real time of claim 1, comprising using computer instructions to graphically plot on the geochemical surface well log, at least one of:

a. a porosity histogram track;
b. a gas graph track;
c. a symbol track;
d. a horizontal line track; and
e. a wellbore profile track.

27. The continuous and automatic method for analyzing fluids from boreholes in near real time of claim 1, further comprising using computer instructions in the well fluid data storage to present a sample picture in the geochemical surface well log.

28. The continuous and automatic method for analyzing fluids from boreholes in near real time of claim 1, comprising using computer instructions in the well fluid data storage to change the geochemical surface well log from a plurality of graphical information tracks to a grid view.

* * * * *